US009701494B1

(12) United States Patent
Mendoza et al.

(10) Patent No.: US 9,701,494 B1
(45) Date of Patent: Jul. 11, 2017

(54) TWO AXIS MEDIA GUIDE SYSTEM FOR AN IMAGING DEVICE

(71) Applicant: LEXMARK INTERNATIONAL, INC., Lexington, KY (US)

(72) Inventors: Jonathan Dela Torre Mendoza, Cebu (PH); Arvin Alain Navarro Aguilar, Cebu (PH); Hannibal Bartolata Aljecera, Mandaue (PH); Douglas Andagan Baena, Jr., Dumaguete (PH); Winston Bercades Gomez, Dumaguete (PH); Philip Adalawan Natad, Cebu (PH); Lowell Libo-On Tacadao, Mandaue (PH)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 15/146,149

(22) Filed: May 4, 2016

(51) Int. Cl.
*B65H 1/08* (2006.01)
*B65H 1/04* (2006.01)
*B65H 1/14* (2006.01)

(52) U.S. Cl.
CPC ..... *B65H 1/08* (2013.01); *B65H 1/04* (2013.01); *B65H 1/14* (2013.01); *B65H 2405/1122* (2013.01); *B65H 2405/1144* (2013.01); *B65H 2405/11425* (2013.01); *B65H 2405/32* (2013.01); *B65H 2405/324* (2013.01); *B65H 2511/10* (2013.01)

(58) Field of Classification Search
CPC ... B65H 1/04; B65H 1/08; B65H 1/14; B65H 2405/32; B65H 2405/324; B65H 2405/1122; B65H 2405/11425; B65H 2405/1144; B65H 2511/10; B65H 2511/11; B65H 2511/12
USPC ..... 271/171
See application file for complete search history.

(56) References Cited

U.S. PATENT DOCUMENTS 4,231,566 A * 11/1980 Suzuki ..... B65H 1/04 221/231
6,883,799 B2 * 4/2005 Matsuki ..... B65H 1/04 271/145
8,469,356 B2 * 6/2013 Kweon ..... B65H 1/14 271/145
8,720,882 B2 * 5/2014 Fuda ..... B65H 1/04 271/171
8,870,179 B2 * 10/2014 Shiraishi ..... B65H 1/14 271/104

(Continued)

*Primary Examiner* — David H Bollinger
(74) *Attorney, Agent, or Firm* — John Victor Pezdek

(57) ABSTRACT

A removable media tray with a two-axis media restraint system having a user-actuated rear media restraint operatively coupled to a side media restraint via a camming member. The rear media restraint includes a latching assembly for slidably latching with one of the indents along a track, each indent corresponding to a supported media length. The camming member having a predefined camming profile surface is coupled to and movable with the rear media restraint. As the rear media restraint moves along the track, camming member moves with the rear media restraint in the same direction engaging first and second cam follower portions of the side media restraint causing the side media restraint to move to contact a side edge of a media stack with the position of the side media restraint depending on a position of the first and second cam follower portions on the camming profile surface.

22 Claims, 26 Drawing Sheets

(56) References Cited

U.S. PATENT DOCUMENTS

| | | | | |
|---|---|---|---|---|
| 2003/0080497 | A1* | 5/2003 | Matsushima | B65H 1/04 271/171 |
| 2013/0062827 | A1* | 3/2013 | Fuda | B65H 1/04 271/147 |
| 2013/0285311 | A1* | 10/2013 | Sugitani | B65H 31/00 271/208 |

* cited by examiner

TWO AXIS MEDIA GUIDE SYSTEM FOR AN IMAGING DEVICE

CROSS REFERENCES TO RELATED APPLICATIONS

None

STATEMENT REGARDING FEDERALLY SPONSORED RESEARCH OR DEVELOPMENT

None.

REFERENCE TO SEQUENTIAL LISTING, ETC

None.

BACKGROUND

Field of the Invention

The field relates generally to media input feed systems for an imaging device having a removable media tray.

Description of the Related Art

Imaging devices utilize one or more removable media trays for holding stacks of media sheets to be processed by the imaging device. The removable media tray may handle a variety of media sizes, such as standard letter size, legal size, and A4. A media restraint mechanism, typically having a rear media restraint and one or more side media restraints, may be employed by the removable media tray to keep the media sheets square to avoid misalignment between the media sheet edges and an image when the media sheet is processed for imaging. The rear media restraint and the one or more side media restraints are typically independent from each other and are typically positioned individually depending on the desired media size, and, thus, require an increase in user interaction and probability of improperly positioning the media restraints.

Particularly, in a High Capacity Input Tray (HCIT), which is capable of storing high volume of media, e.g., 2000 sheets or more, problems usually occur during a wrong positioning of either the one or more side media restraints or the rear media restraint. For example, setting the side media restraint on a wider size may cause pick skew, while setting the side media restraint on a narrower size may cause media feed jams. Further, some HCITs are not able to support smaller media sizes, such as A5, and require a separate part connected to the rear media restraint assembly to accommodate this shorter media type. Setting this separate part in place requires an additional step to the customer to support such media sizes, as well an increase in cost and complexity.

It would be advantageous to be able to activate the rear and side media restraints with a single actuation, reducing user interaction and complexity. It would be further advantageous to eliminate the use of a separate part to support smaller media sizes, reducing additional costs and operations needed.

SUMMARY OF THE INVENTION

Disclosed is a removable media tray having a two-axis media guide system. The removable media tray comprises a first wall and a second wall defining a media storage area. The first wall is positioned transverse to a media feed direction having an inner surface forming a leading edge media reference surface for a media stack within the media storage area. The second wall is parallel to the media feed direction having an inner surface forming a side edge media reference surface for the media stack. The two-axis media restraint system is positioned within the media storage area and has a rear media restraint connectively coupled to a side media restraint via a camming assembly. The rear media restraint is adjustably mounted within the media input tray and moveable in the media storage area toward and away leading edge media reference surface over a predetermined range of travel to one of a plurality of selectable predetermined positions each spaced from the leading edge media reference surface. The rear media restraint has a latching assembly for slidably latching with the media input tray at a selected one of the plurality of selectable predetermined positions, and has a first state latched to the media input tray, and, when actuated, a second state unlatched from the media input tray allowing the rear media restraint to be moved within the predetermined range of travel.

The side media restraint is mounted within the media input tray opposite to the side edge media reference surface and is moveable by the camming assembly in a direction transverse to the media feed direction and the side edge media reference surface as the rear media restraint travels to one of the plurality of selectable predetermined positions. Side media restraint includes a first vertical member for contacting a side edge of a media stack and a translation assembly having a first translation link having a first end and an opposed second end. The first end of the first translation link is pivotally attached to a top end of the first vertical member. The first translation link has a first cam follower portion adjacent the second end thereof, and a biasing member operatively coupled between the first translation link and the media input tray for biasing the camming portion of translation link toward the camming member. The camming member has a predefined camming profile surface and is coupled to and moveable with the rear media restraint and is slidably engaged with the cam follower portion of the first translation member when the rear media restraint is within the predetermined range of travel.

With the latching assembly in the second state and upon movement of the rear media restraint with the predefined range of travel, the camming assembly moves with the rear media restraint in the same direction and the cam follower portion of the first translation link travels along the camming profile surface causing the first translation link to move the side media restraint transversely to the side edge media reference surface with the position of the side media restraint dependent on a position of the cam follower portion of the first translation link on the predefined camming profile surface.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings.

FIG. 10A shows a latching assembly in a latched position; and, FIG. 10B shows an unlatched position.

FIG. 11A shows a latched state and corresponds to FIG. 10A; FIG. 11B shows a transitional state between the latch and unlatched states; and, FIG. 11C shows the unlatched state corresponding to FIG. 10B.

FIG. 22 shows the two-axis media guide system positioned for a Legal media type; FIG. 23 shows the two-axis media guide system positioned for an Oficio media type; FIG. 24 shows the two-axis media guide system positioned for a Folio media type; FIG. 25 shows the two-axis media guide system positioned for an A4 media type; FIG. 26 shows the two-axis media guide system positioned for a Letter media type; and, FIG. 27 shows the two-axis media guide system positioned for an A5 media type.

DETAILED DESCRIPTION

Figure 1:
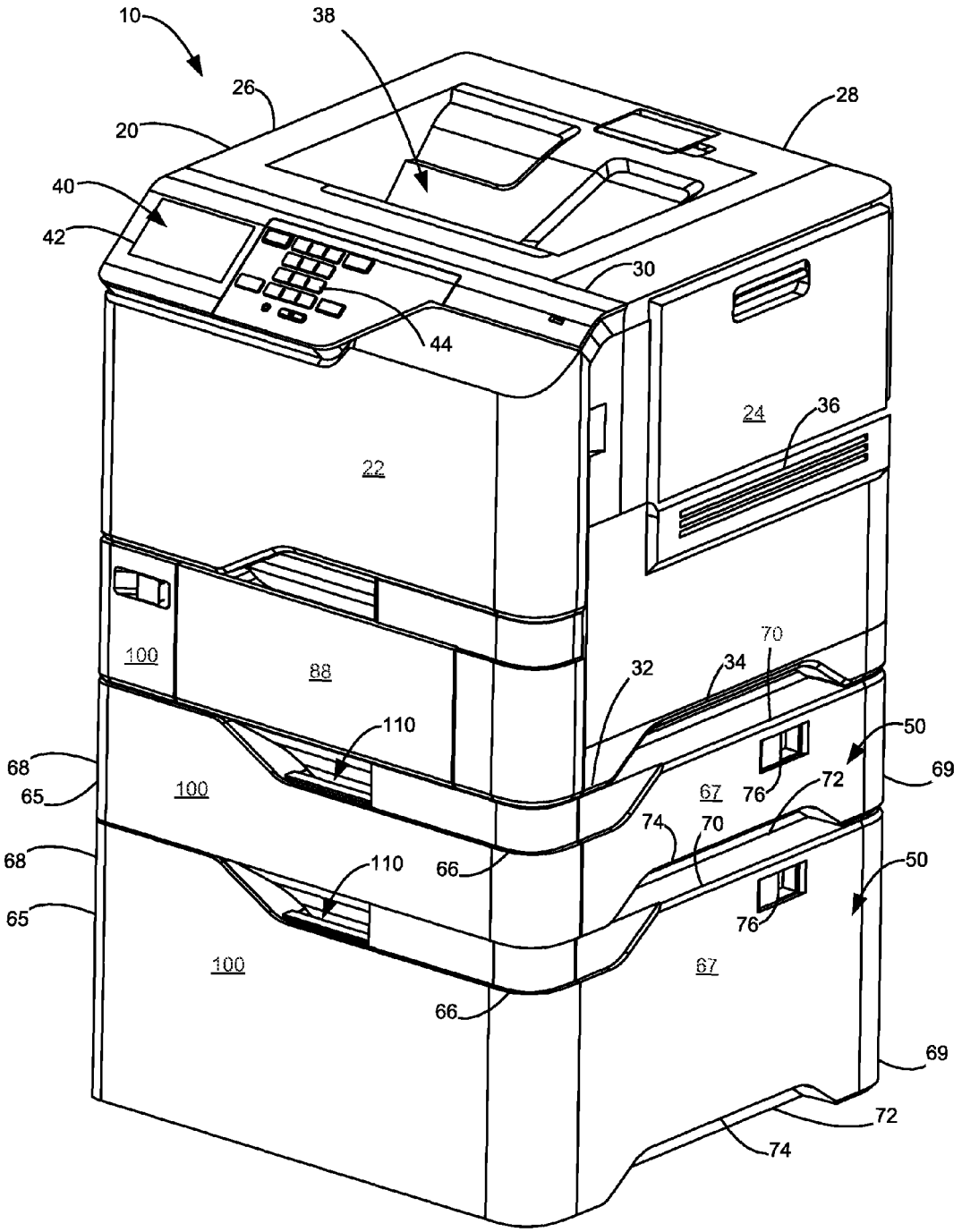
FIG. 1 is an illustration of an imaging device having a removable media tray attached to a stack of option assemblies each having a removable media tray.

It is to be understood that the present disclosure is not limited in its application to the details of construction and the arrangement of components set forth in the following description or illustrated in the drawings. The present disclosure is capable of other embodiments and of being practiced or of being carried out in various ways. Also, it is to be understood that the phraseology and terminology used herein is for the purpose of description and should not be regarded as limiting. As used herein, the terms "having", "containing", "including", "comprising", and the like are open ended terms that indicate the presence of stated elements or features, but do not preclude additional elements or features. The articles "a", "an" and "the" are intended to include the plural as well as the singular, unless the context clearly indicates otherwise. The use of "including", "comprising", or "having" and variations thereof herein is meant to encompass the items listed thereafter and equivalents thereof as well as additional items.

Terms such as "about" and the like have a contextual meaning, are used to describe various characteristics of an object, and have their ordinary and customary meaning to persons of ordinary skill in the pertinent art. Terms such as "about" and the like, in a first context mean "approximately" to an extent as understood by persons of ordinary skill in the pertinent art; and, in a second context, are used to describe various characteristics of an object, and in such second context mean "within a small percentage of" as understood by persons of ordinary skill in the pertinent art.

Unless limited otherwise, the terms "connected", "coupled", and "mounted", and variations thereof herein are used broadly and encompass direct and indirect connections, couplings, and mountings. In addition, the terms "connected" and "coupled" and variations thereof are not restricted to physical or mechanical connections or couplings. Spatially relative terms such as "left", "right", "top", "bottom", "front", "back", "rear", "side", "under", "below", "lower", "over", "upper", and the like, are used for ease of description to explain the positioning of one element relative to a second element. These terms are intended to encompass different orientations of the device in addition to different orientations than those depicted in the figures. Relative positional terms may be used herein. For example, "superior" means that an element is above another element. Conversely "inferior" means that an element is below or beneath another element. Further, terms such as "first", "second", and the like, are also used to describe various elements, regions, sections, etc. and are also not intended to be limiting. Where possible, like terms refer to like elements throughout the description. A plurality of different structural components may be utilized to implement the media restraint of the present disclosure. Furthermore, and as described in subsequent paragraphs, the specific mechanical configurations illustrated in the drawings are intended to exemplify embodiments of the present disclosure and that other alternative mechanical configurations are possible.

"Media" or "media sheet" refers to a material that receives a printed image or, with a document to be scanned, a material containing a printed image. The media is said to move along a media path, a media branch, and a media path extension from an upstream location to a downstream location as it moves from the media trays to the output area of the imaging system. For a top feed option tray, the top of the option tray is downstream from the bottom of the option tray. Conversely, for a bottom feed option tray, the top of the option tray is upstream from the bottom of the option tray. As used herein, the leading edge of the media is that edge which first enters the media path and the trailing edge of the media is that edge that last enters the media path. Depending on the orientation of the media in a media tray, the leading/trailing edges may be the short edge of the media or the long edge of the media, in that most media is rectangular. As used herein, the term "media width" refers to the dimension of the media that is transverse to the direction of the media path.

The term "media length" refers to the dimension of the media that is aligned to the direction of the media path. "Media process direction" describes the movement of media within the imaging system, and is generally means from an input toward an output of the imaging device. The terms "front" "rear" "left" and "right" as used herein for the removable media tray and its components are with reference to the removable media tray being inserted in the imaging device or option assembly as viewed in FIG. 1.

FIG. 1 illustrates an example imaging device 10 atop two example option assemblies 50. Imaging device 10 has a housing 20 having a front 22, first and second sides 24, 26, a rear 28, a top 30 and a bottom 32 and into which a removable media tray 100 is slidably inserted. Removable media tray 100 may also be referred to herein as media tray 100. Option assembly 50 has a housing 65 having a front 66, first and second sides 67, 68, a rear 69, a top 70 and a bottom 72 and into which removable media tray 100 is slidably inserted. A user interface 40, comprising a display 42 and a key panel 44, may be located on the front 22 of housing 20. Using the user interface 40, a user is able to enter commands and generally control the operation of the imaging device 10. For example, the user may enter commands to switch modes (e.g., color mode, monochrome mode), view the number of images printed, take the imaging device 10 on/off line to perform periodic maintenance, and the like. A media output area 38 for receiving printed media is provided in the top 30. A multipurpose input tray 88 folds out from the front of the removable media tray 100 in imaging device 10 and may be used for handling envelopes, index cards or other media where only a small number of the media will be printed. The multipurpose tray 88 may also be incorporated into front 22 of housing 20 rather than being incorporated into removable media tray 100. Hand grips 34, 74 are provided in several locations on housings 20, 65, respectively, such as on sides 24, 26, 67, 68. Also, ventilation openings, such as vents 36 are provided on imaging device 10 such as those shown on first side 24. Latches 76 are provided on each option assembly 50 to secure it to either imaging device 10 or a superior option assembly 50 in the stack.

Option assemblies 50 may be removed or added to the stack. As each option assembly 50 is added, the media path is extended. The option assemblies 50 are stackable allowing one or more option assemblies 50 to be used with a single imaging device 10 that is typically positioned on top of the uppermost option assembly 50 in the stack. Typically, each option assembly 50 may contain a different type of media such as letterhead or a different size such as A4 or a larger quantity of the same media type that is found in the removable media tray 100 integrated into imaging device 10. Each removable media tray 100 is sized to contain a stack of media sheets that will receive color and/or monochrome images. Each removable media tray 100 may be sized to hold the same number of media sheets or may be sized to hold different quantities of media sheets. Example media sizes include but are not limited to A6, 8½"×11", A4, Folio, Oficio, and Legal. In some instances, the removable media tray 100 in imaging device 10 may hold a lesser, equal or greater quantity of media than a removable media tray 100 found in an option assembly 50.

Figure 2:
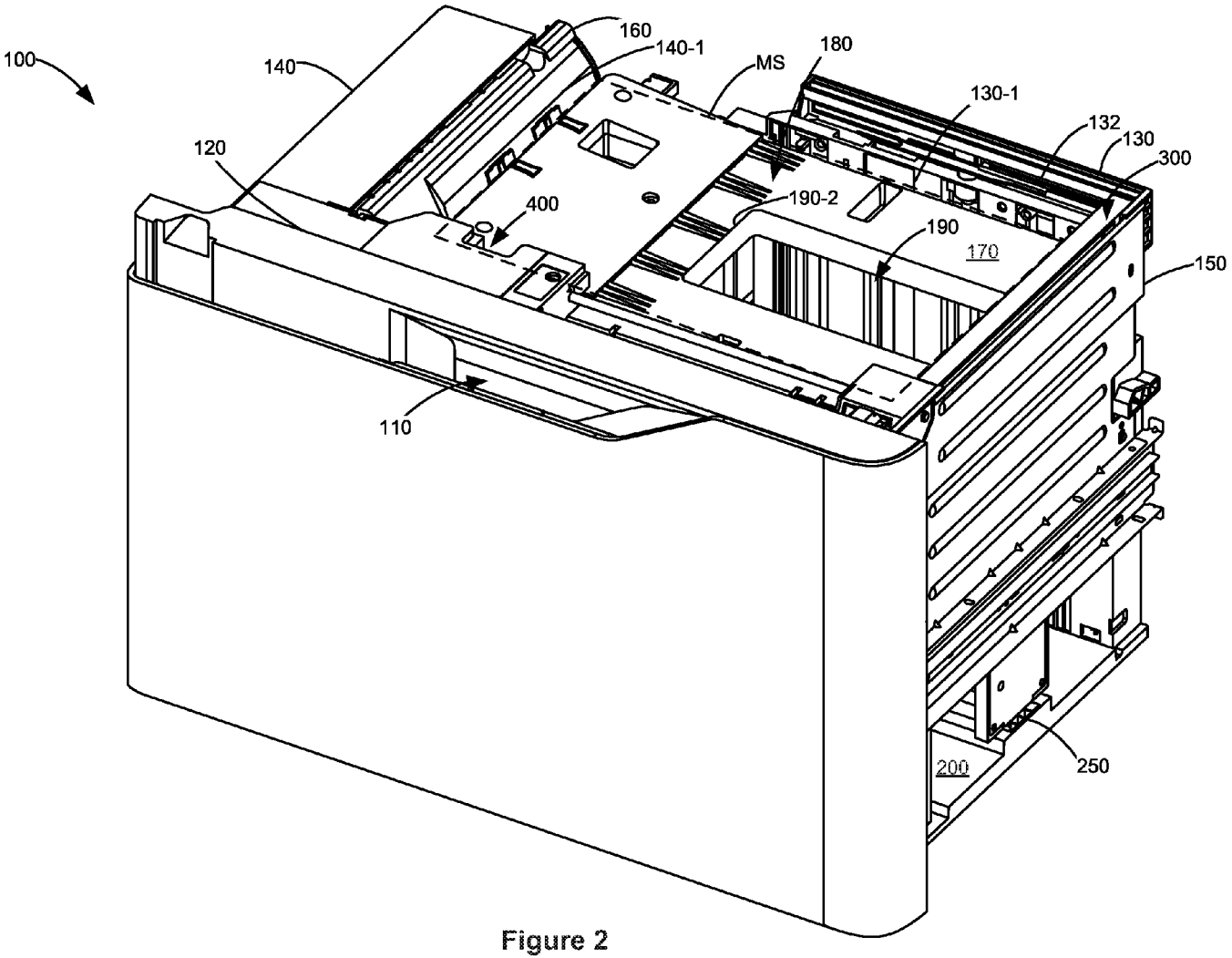
FIG. 2 is a front perspective view of a removable media tray for the imaging device of FIG. 1 having a two-axis media guide system of the present disclosure.
Figure 3:
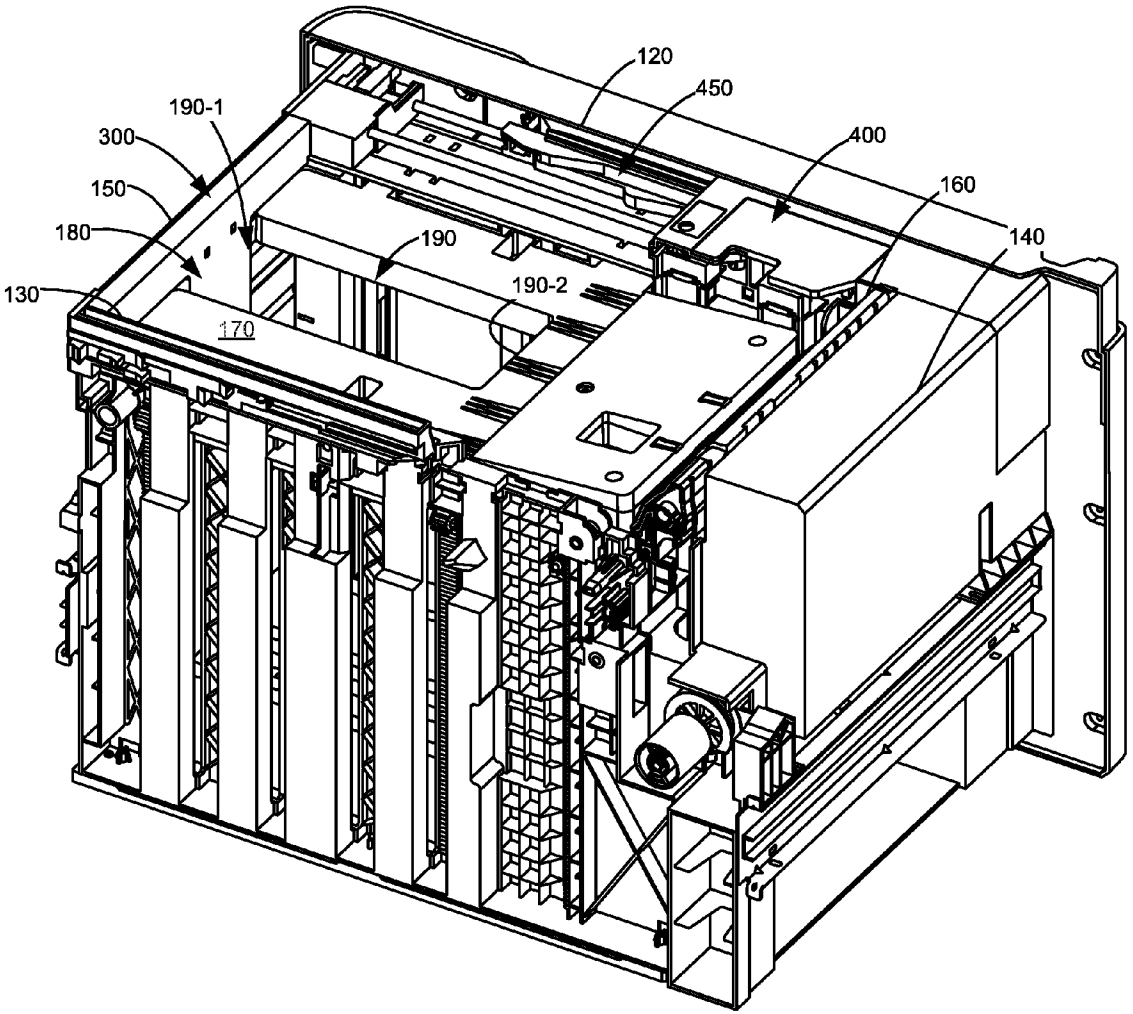
FIG. 3 is a rear perspective view of the removable media tray of FIG. 2.
Figure 4:
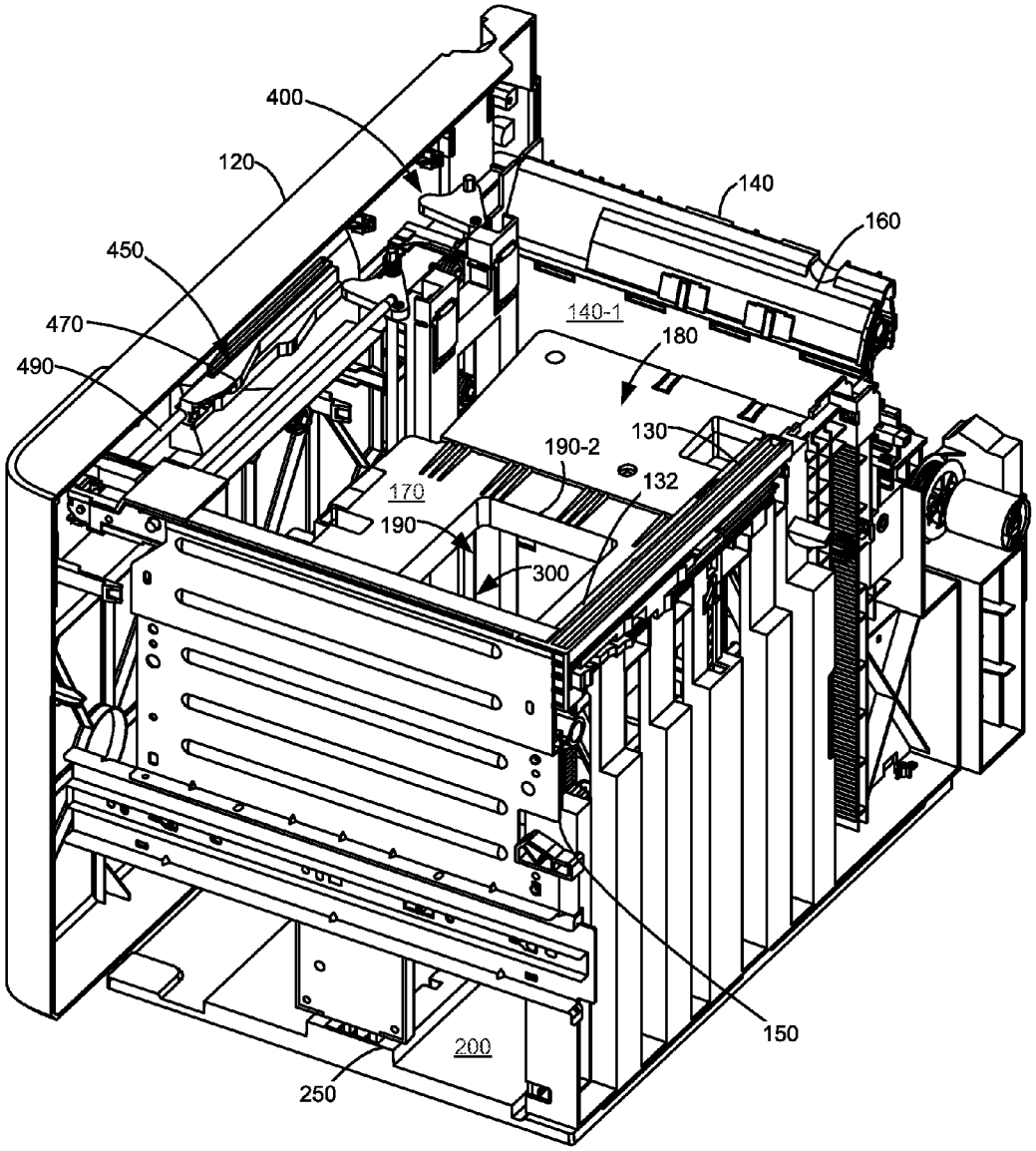
FIG. 4 is a side perspective view of the removable media tray of FIG. 2.

Referring to FIGS. 2-4, removable media tray 100 is shown. In this example embodiment, removable media tray 100 is a high-capacity input media tray (HCIT). For example, removable media tray 100 may be sized to hold approximately 2200 pages of 20 pound media which has a media stack height of about 235 mm. High-capacity input trays are capable of supporting a media weight of up to 32 pounds. Removable media tray 100 has a front wall 120, a rear wall 130, a left side wall 140, and a right side wall 150 mounted on a bottom plate 200. Media storage area 180 is generally defined by bottom plate 200 and, at a minimum, walls 130, and 140.

A media dam 160 is mounted at an upper portion of the left side wall 140 and is used to deflect media being fed from removable media tray 100 into the media path. An elevator plate 170, is used to raise or lower a media stack MS, is operatively coupled with a lift mechanism (not shown) provided in imaging device 10, and is slidably attached to the front wall 120 and rear wall 130.

In the example embodiment, removable media tray 100 is an edge referenced media tray meaning that the media stack MS is positioned against the left side wall 140 and one of the front and rear walls 120, 130 and, as shown, aligned with the rear wall 130 that has an inner surface 130-1 forming a side edge media reference surface 130-1. Left side wall 140 has an inner surface 140-1 forming a leading edge media reference surface 140-1 for the media stack MS indicated by the dashed lined rectangle in FIG. 2. A handle 110 is provided at the front of removable media tray 100 for removing and inserting removable media tray 100 into imaging device 10 or option assembly 50.

In the example embodiment, removable media tray 100 is shown having a rear media restraint 300 shown positioned parallel to the right side wall 150 and a side media restraint 400 positioned adjacent to or in the front wall 120 in the media storage area 180 and also adjacent to left side wall 140 and operatively connected via a camming assembly 450. Rear media restraint 300 is movable within media storage area 180 to contact a rear edge of the media stack having a particular media size. Camming assembly 450 is coupled to rear media restraint 300 and slidably engaged with the side media restraint 400 such that the movement of rear media restraint 300 to a position corresponding to a length of a given media size causes the camming assembly 450 to move together with rear media restraint 300 in the same direction, translating side media restraint 400 to a position corresponding to the width of that given media size and contacting a side edge of the media stack MS.

Figure 5:
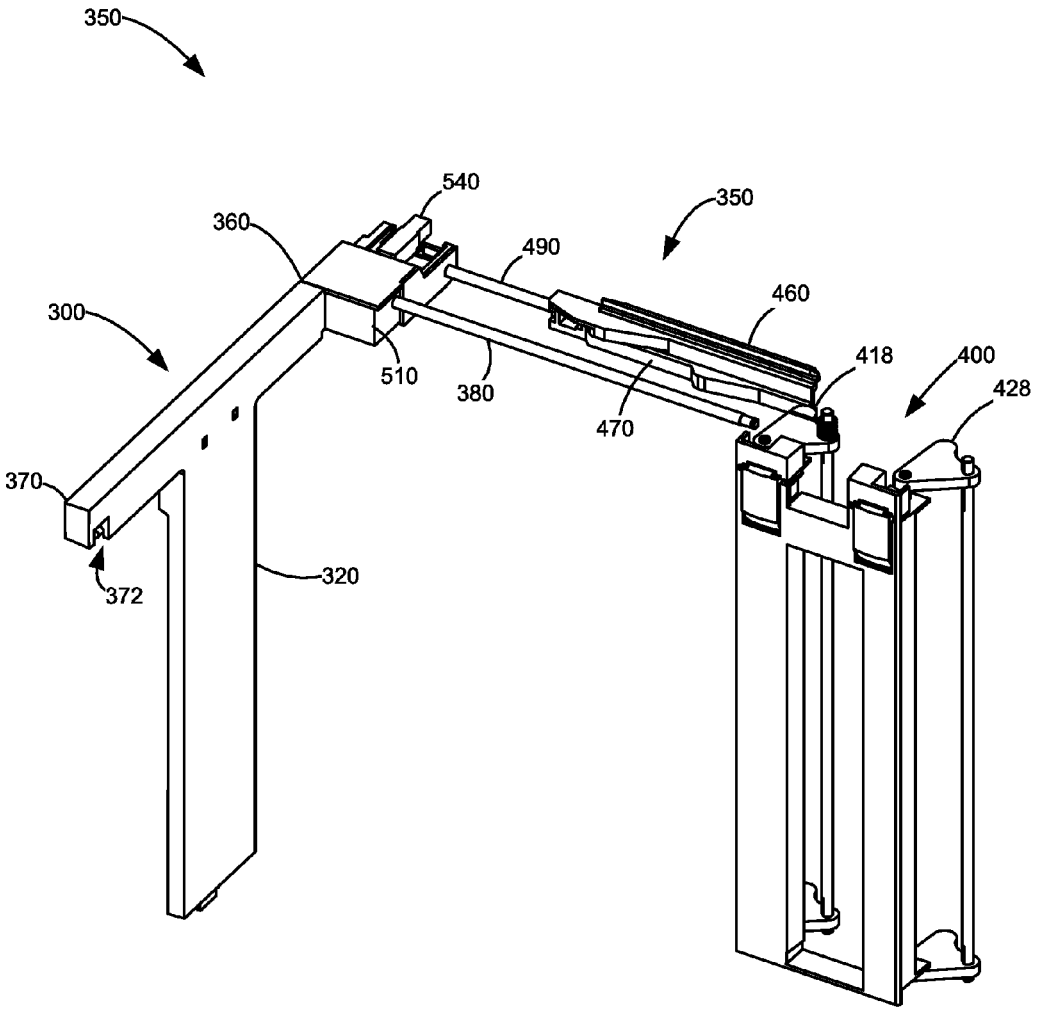
FIG. 5 is a front perspective view of the two-axis media guide system of FIG. 2 positioned at a longest designed-for media length.
Figure 6:
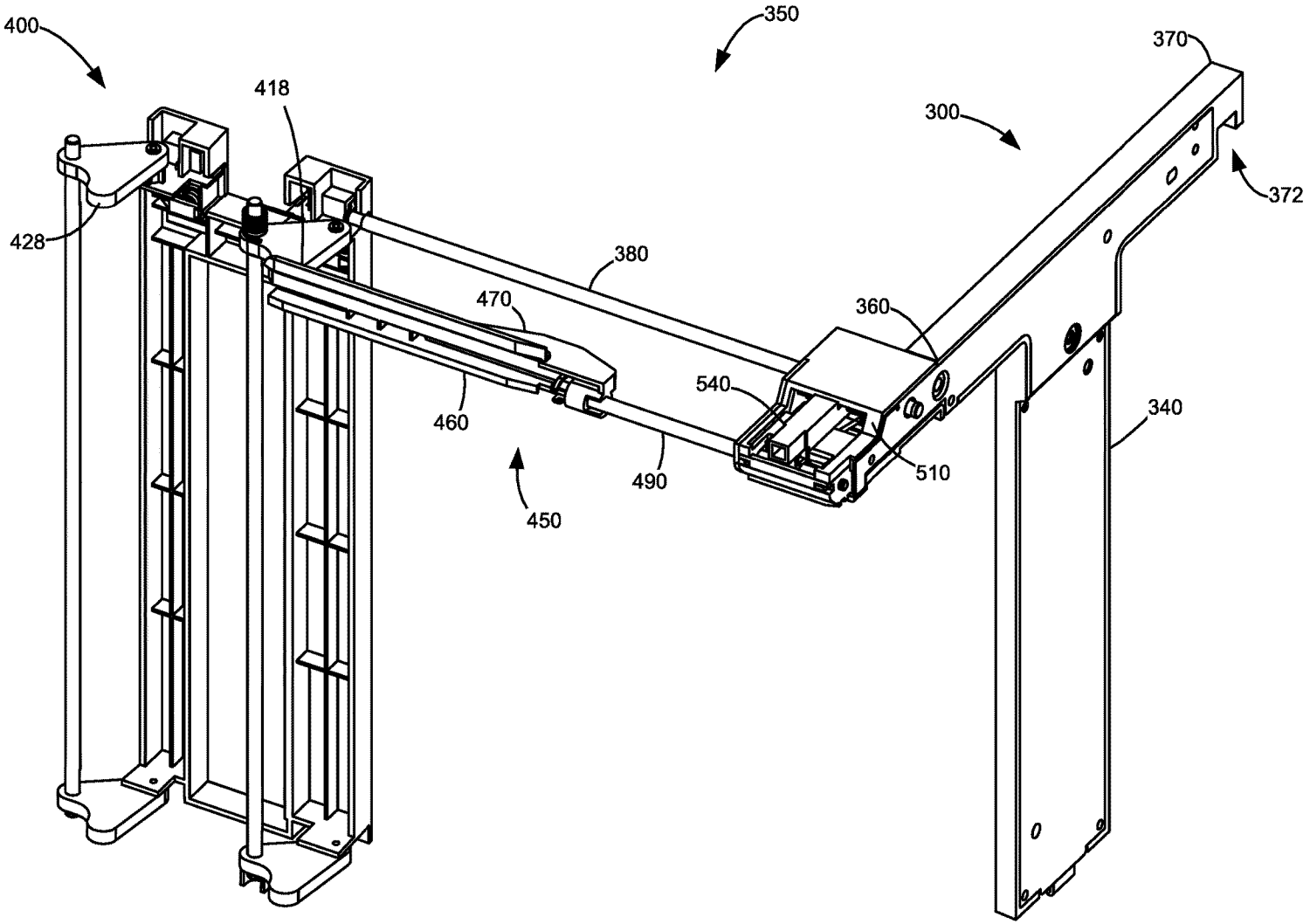
FIG. 6 is a rear perspective view of the two-axis media guide system of FIG. 2.
Figure 16:
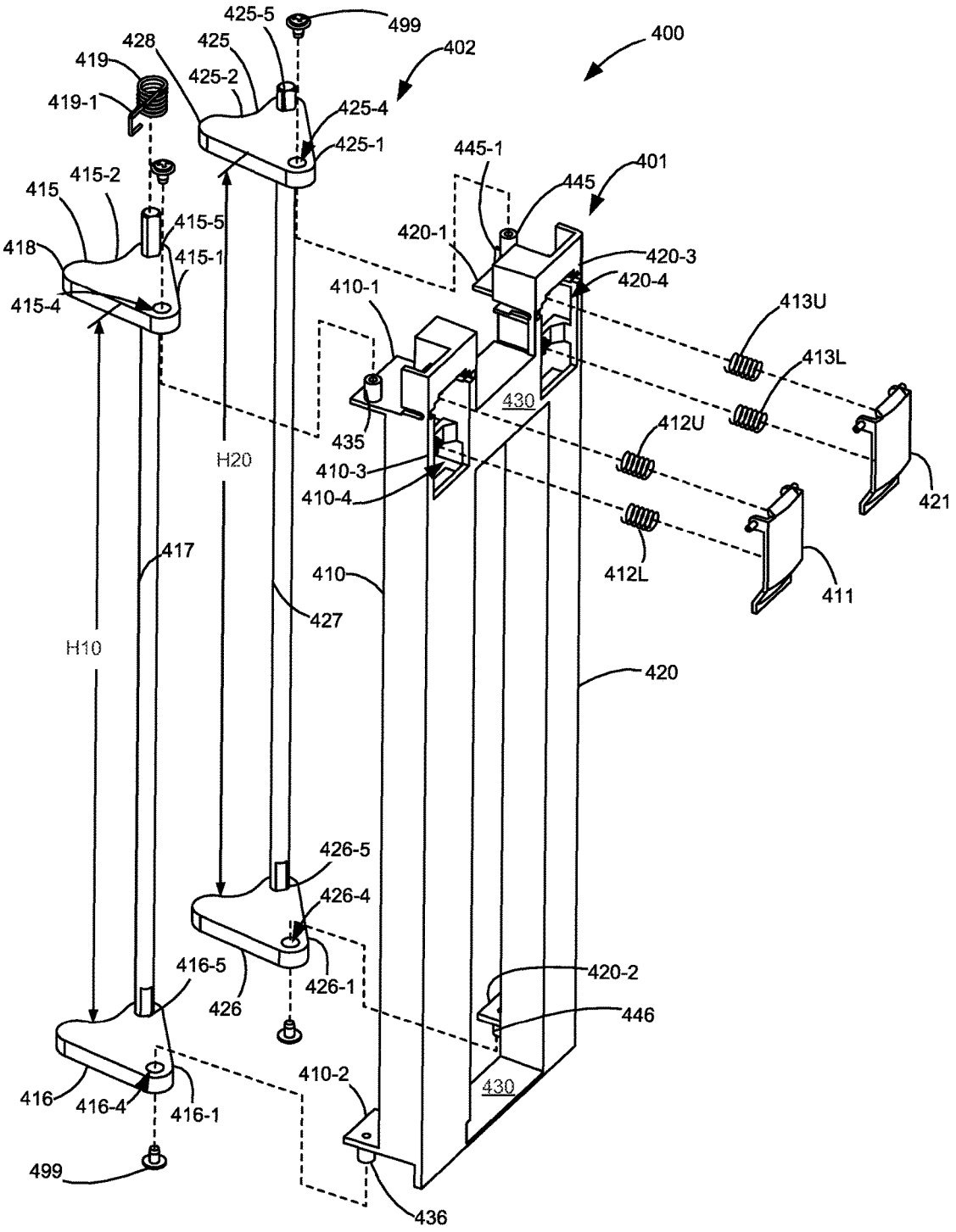
FIG. 16 is an exploded view of a side media restraint of the two-axis media guide system of FIG. 5.

Referring to FIGS. 5-6, an example two-axis media guide system 350 is shown. The two-axis media guide system 350 comprises rear media restrain 300 coupled to side media restraint 400 via a camming assembly 450. Rear media restraint 300 includes a T-shaped front plate 320 for contacting the bottom edge of the media stack, a T-shaped back plate 340, opposed first and second ends 360,370, a latch housing 510 coupled to the first end 360 of rear media restraint 300 which is slidably movable along a guide rod 380 mounted at one end to right side wall 150 and at the other end to an end wall of a rear wall of channel 122 (see FIG. 17) provided in the top of front wall 120, an actuator 540 slidably mounted on the latch housing 510 and used when moving rear media restraint 300 within the media storage area 180, and a side guide slot 372 may be provided near the second end 370 and slides along top portion 132 of rear wall 130. Camming assembly 450 includes a camming member 460 attached to latch housing 510 via a support rod 490. Camming member 460 has a predefined camming profile surface 470 (see FIGS. 16-17) having varying heights with each height corresponding to a width of a corresponding supported media size. When rear media restraint 300 is moved using actuator 540, latch housing 510 pushes the camming member 460 to engage first and second cam follower portions 418, 428 coupled to the side media restraint 400. As the cam follower portions 418, 428 slide along the predefined camming profile surface 470 of camming member 460, cam follower portions 418, 428 change position as it contacts each of the varying heights provided on the camming profile surface 470, and, in turn, translate side media restraint 400 to contact a side edge of the media stack MS. As shown, example two-axis media guide system 350 is illustrated positioned at the longest designed-for supported media size, i.e., Legal, wherein rear media restraint 300 is located at its rightmost position as viewed in the Figures and the camming profile surface 470 contacts first cam follower portion 418 of side media restraint 400. Features of side media restraint 400 are further described in FIGS. 16-21.

Figure 7:
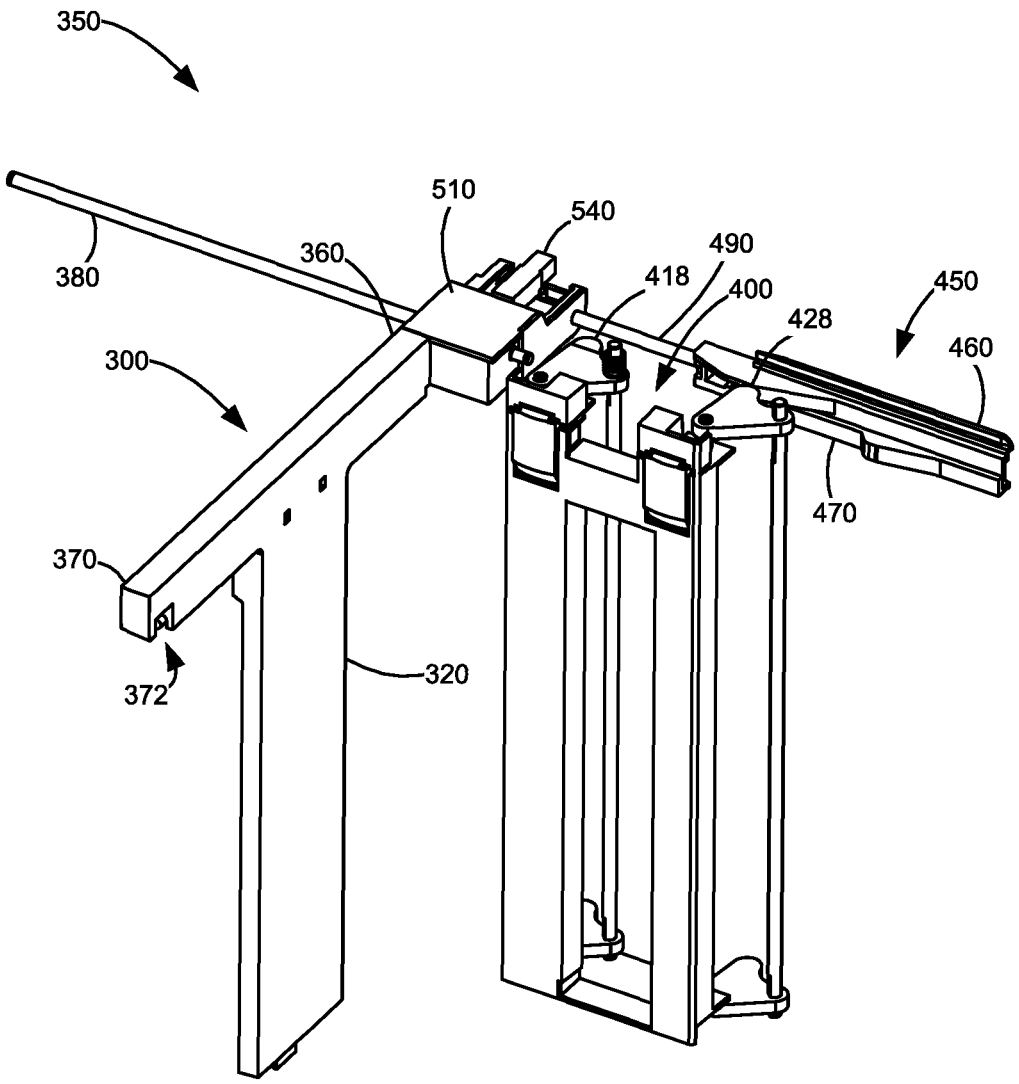
FIG. 7 is a front perspective view of the two-axis media guide system of FIG. 2 positioned at a shortest designed-for media length.

FIG. 7 illustrates rear media restraint 300 positioned at the shortest designed-for supported media size, wherein rear media restraint 300 has been moved to its leftmost position, pushing camming member 460 to an extent where the second cam follower portion 428 of side media restraint 400 contacts camming profile surface 470 at a different point which moves side media restraint 400 to a different position with respect to side edge media reference surface 130-1.

Figure 12:
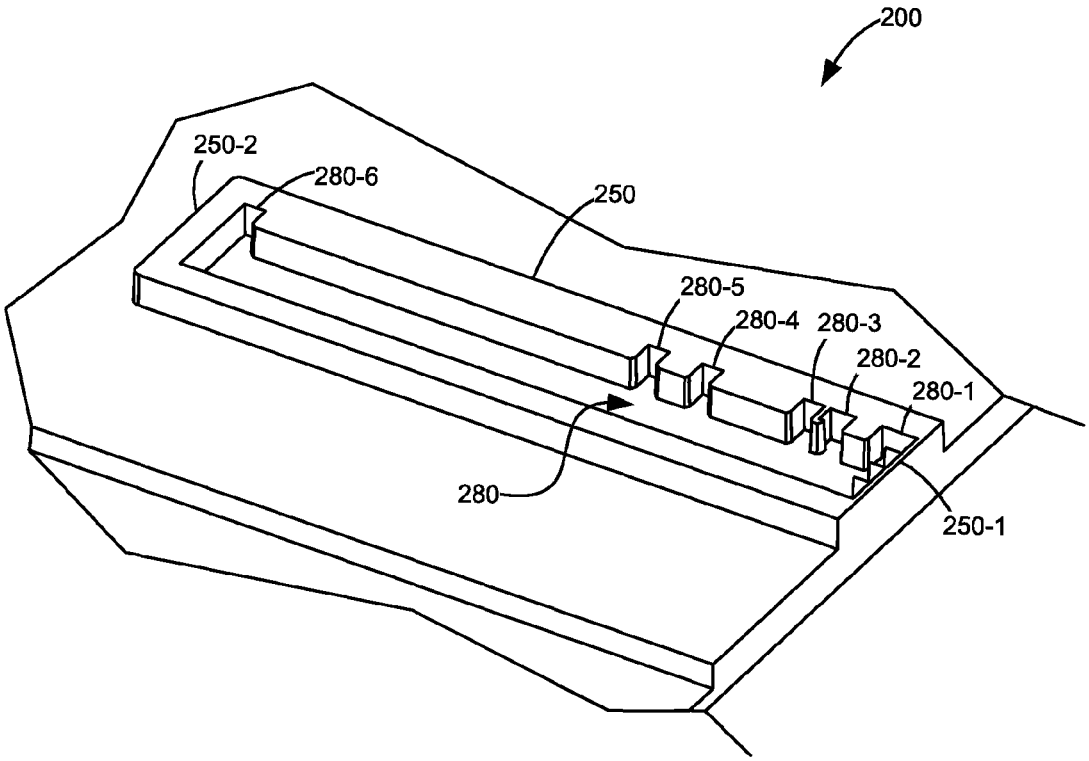
FIG. 12 is a perspective view of a track on a bottom plate of the removable media tray of FIG. 2.

Referring back to FIGS. 2-4 and also to FIG. 12, user-actuated rear media restraint 300 is latchable and slidable along a track 250 provided on bottom plate 200. Rear media restraint 300 is brought into contact with a rear edge of the media stack of a supported media type and is latched into place. Elevator plate 170 includes a U-shaped opening 190 having an open end 190-1 located adjacent to right side wall 150 enabling rear media restraint 300 to move along track 250 and a closed end 190-2 that is positioned at a predetermined distance from the left side wall 140 that may be shorter than the shortest length of supported media. Where A5 is the shortest supported media type, then the predetermined distance may be about 140 mm. With reference to FIG. 12, bottom plate 200 includes track 250 that extends from a first end 250-1 adjacent to right side wall 150 to a second end 250-2 approximately aligned to the closed end 190-2 of elevator plate 190. Track 250 has a plurality of indents, 280, with each indent located at predetermined positions along the length of track 250 that correspond to media lengths for the supported media sizes or types. Six indents 280-1, 280-2, 280-3, 280-4, 280-5, and 280-6 are shown that correspond to media lengths for Legal, Oficio, Folio, A4, Letter, and A5 media types, respectively. Rear media restraint 300 has a translatable L-shaped latch member that latches into one of the plurality of indents 280 based on the media type present in media storage area 180.

Figure 13:
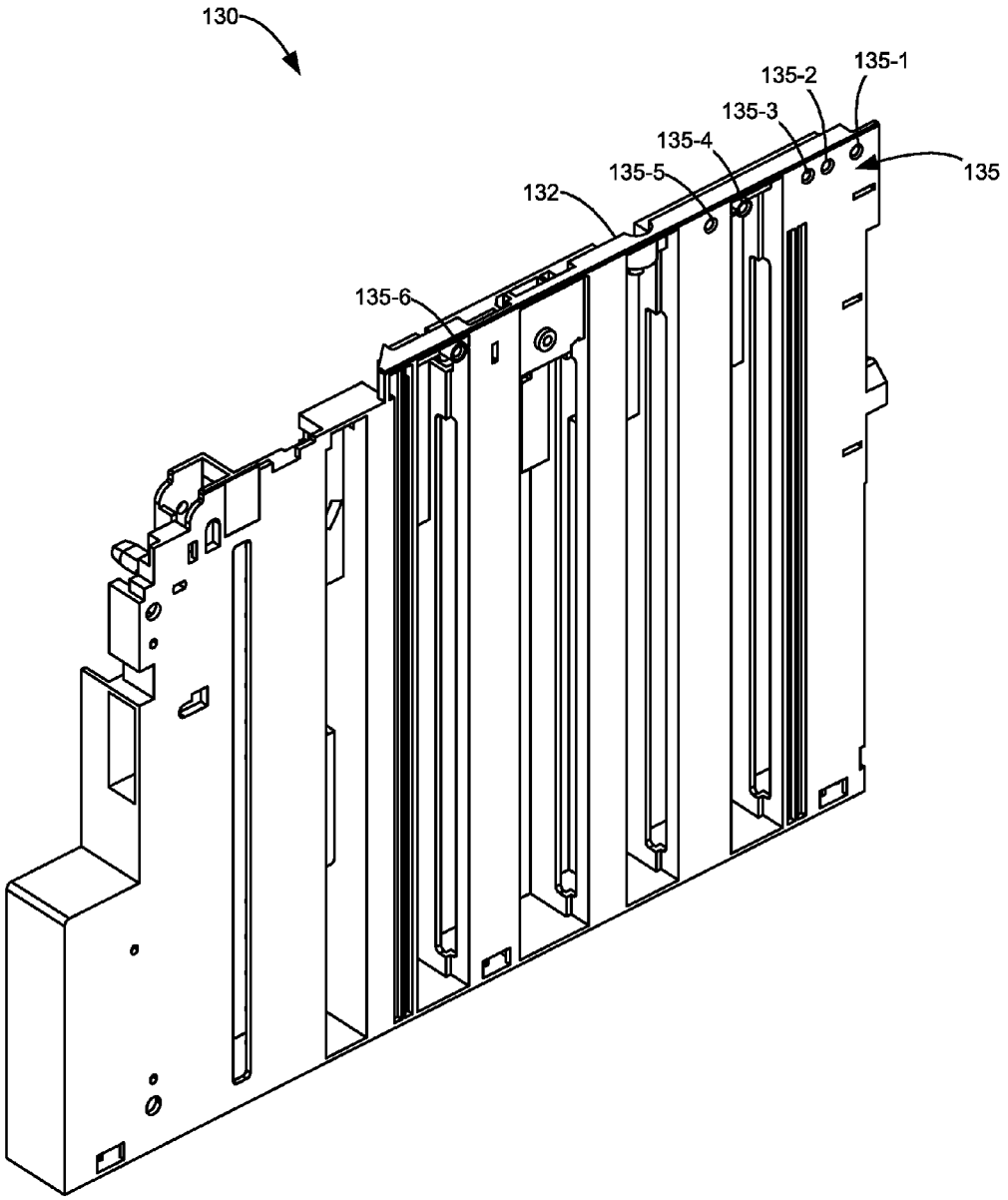
FIG. 13 is an elevation view of a rear wall of the removable media tray of FIG. 2.

With reference to FIG. 13, rear wall 130 is shown including top portion 132 having a plurality of detents, 135, with each detent located at predetermined positions along rear wall 130 corresponding to media lengths for the supported media sizes or types and to the plurality of indents 280. As shown, six detents 135-1, 135-2, 135-3, 135-4, 135-5, and 135-6 are spaced at predetermined distances from the leading edge media reference surface 140-1 that correspond to media lengths for Legal, Oficio, Folio, A4, Letter, and A5 media types, respectively. As rear media restraint 300 latches to one of the plurality of indents 280 for a supported media size, rear media restraint 300 also latches to a corresponding one of the plurality of detents 135 for that same media size. For example, if rear media restraint 300 is latched to indent 280-1 for a Legal media size, rear media restraint 300 would, in turn, latch to detent 135-1 using side wall catch rod 320 shown in FIG. 8. Slot 372 near second end 370 of rear media restraint 300 travels along top portion 132.

Figure 8:
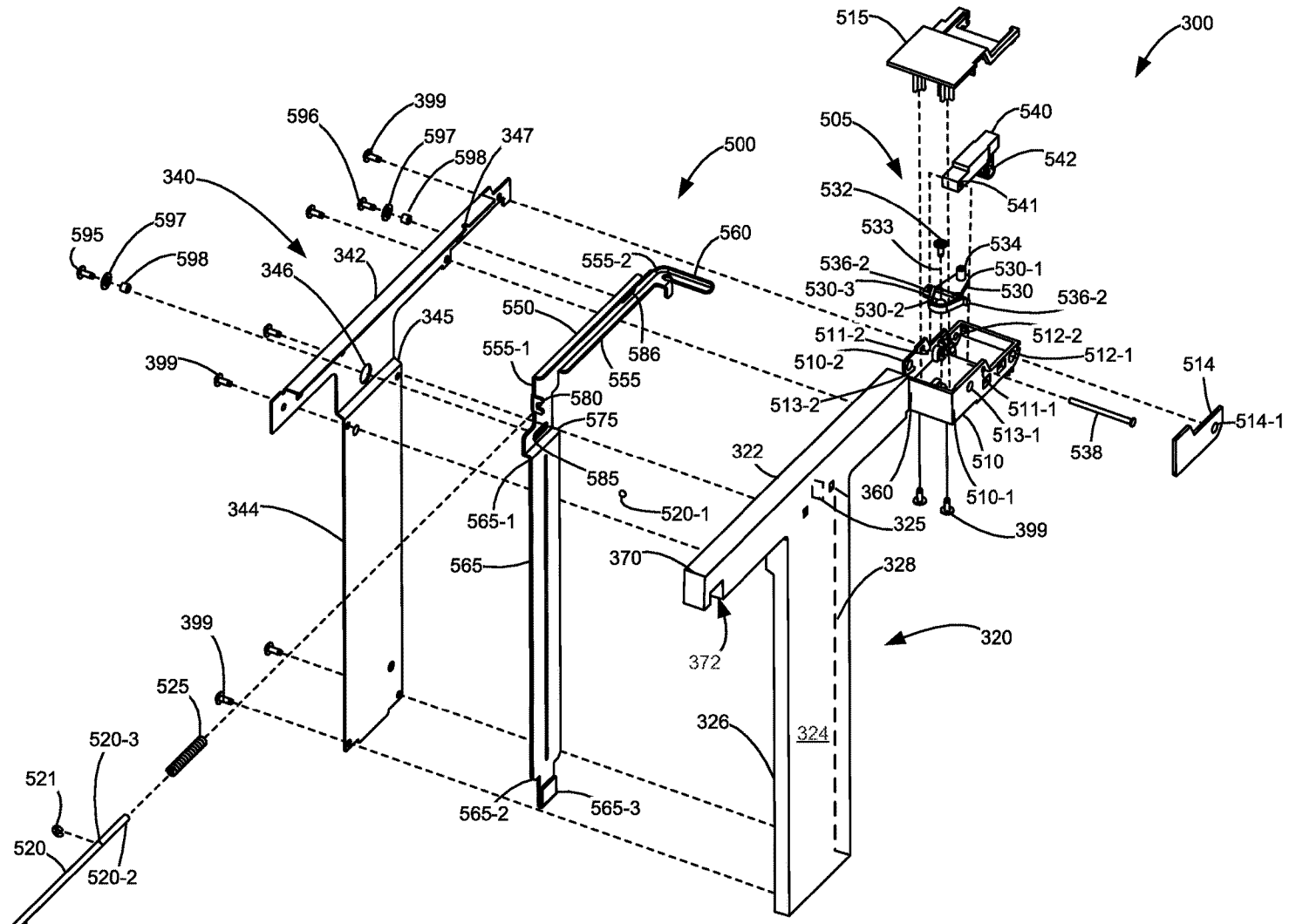
FIG. 8 is an exploded view of a rear media restraint of the two-axis media guide system of FIG. 5.

Referring to FIG. 8, an exploded view of example rear media restraint 300 is shown to further illustrate each of the components of rear media restraint 300, including, latching assembly 500. Rear media restraint 300 has a T-shaped front plate 320 having a top bar 322 and a vertical portion or leg 324 depending therefrom. Left and right side flanges 326, 328 are provided on vertical portion 324. A matching T-shaped rear plate 340 is attached to front plate 320 with a plurality of fasteners 399. Latching assembly 500 is mounted between front and rear plates 320, 340. Rear plate 340 has a top bar 342 and a vertical portion or leg 344 depending downwardly therefrom. An offset 345 is provided in leg 344 adjacent to top bar 342. An opening 346 is provided through leg 344 above the offset 345 and an opening 347 is provided in top bar 342 spaced apart from opening 346.

Latching assembly 500 includes an actuation mechanism 505 coupled to an L-shaped member 550 having a side wall catch rod 520 mounted thereon. L-shaped member 550 has a horizontal top portion 555 having opposed first and second ends 555-1, 555-2, a horizontal extension 560 extending generally orthogonally out from the second end 555-2 of top portion 555 in a direction transverse to top portion 555 and received in housing 510, a vertical portion or leg 565 having opposed top and bottom ends 565-1, 565-2 extending downwardly from top portion 555. A bottom latch 565-3 extends from distal or bottom end 565-2 of leg 565 and is received into one of the plurality of indents 280 along track 250 for latching rear media restrain 300 to track 250. The side wall catch rod 520 has a first or distal end 520-1, a second end 520-2 and a groove 520-3 inboard of second end 520-2 and extends parallel to top portion 555. Catch rod 520 is attached at groove 520-3 to a bracket 580 via a C-clip 521. Bracket 580 extends transversely from the first end 555-1 of top portion 555. The first end 520-1 of catch rod 520 acts as a catch and is sized to be received into one of the plurality of detents 135 in rear wall 130 as rear media restraint 300 is adjusted. A coil spring 525 is slipped over the portion of catch rod 520 that extends rearward of its attachment to bracket 580. Spring 525 is mounted between bracket 580 and a spring stop 325 (see also FIG. 9) provided on front plate 320 adjacent the second end 520-2 of side wall catch rod 520 for biasing the side wall catch rod 520 towards rear wall 130. An offset portion 575 of leg 565 is located adjacent to first end 565-1 of leg 565 and rides on top of the corresponding offset portion 345 of leg 344 of the T-shaped back plate 340. First slot 585 is positioned above offset 572 and second slot 586 is positioned adjacent second end 555-2. Openings 346, 347 are aligned with the respective ends of slots 585, 586 that are closest to horizontal extension 560. Pins 595, 596, each having a washer 597 and sleeve 598, extend through openings 346, 347, respectively, where sleeves 598 of pins 595, 596 are received into slots 585, 586, respectively, and act as bearings allowing L-shaped member 550 to be slidably coupled to rear plate 340 as shown in FIG. 10A and its inset.

Actuation mechanism 505 is mounted in housing 510 having a front and a rear wall 510-1, 510-2, respectively. Actuation mechanism includes a pivot member 530 mounted in housing 510 by pin 532 and is rotatable about a pivot axis 533. Pivot member 530 has opposed first and second ends 530-1, 530-2, a pivot opening 530-3, a pivot post 534 mounted on a top surface adjacent the first end 530-1, and front and rear camming surfaces 536-1, 536-2 located inboard of pivot opening 530-3 that will ride against the horizontal extension member 560 during latching and unlatching of rear media restraint 300. Housing 510 further includes a cover 515 for enclosing a top portion of housing 510 that is secured by fasteners 399, and aligned openings 512-1, 512-2 in the front and rear walls 510-1, 510-2, respectively. A plate 514 is attached to a front portion of housing 510 having an opening 514-1 aligned with openings 512-1, 512-2. Opposed opening 513-1, 513-2 are positioned on the front and rear wall of housing 510 through which guide rod 380 passes.

An actuator guide rod 538 extends from first end 340-1 of the T-shaped back plate 340 and passes through aligned openings 511-1, 511-2 in the front and rear walls 510-1, 510-2, respectively, of housing 510. Actuator 540 is slidably mounted, via opening 541 therein, to actuator guide rod 538 and has a bottom opening 545 (see FIG. 11B) for receiving pivot post 534. Actuator 540 further includes a sleeve 542 depending from the bottom thereof. An end of support rod 490 passes through the openings 512-1 and sleeve 542 and may be threaded into opening 512-2 in rear wall 510-2. Actuator 540 slides along actuator guide rod 530 and support rod 490 that are parallel to one another.

Figure 9:
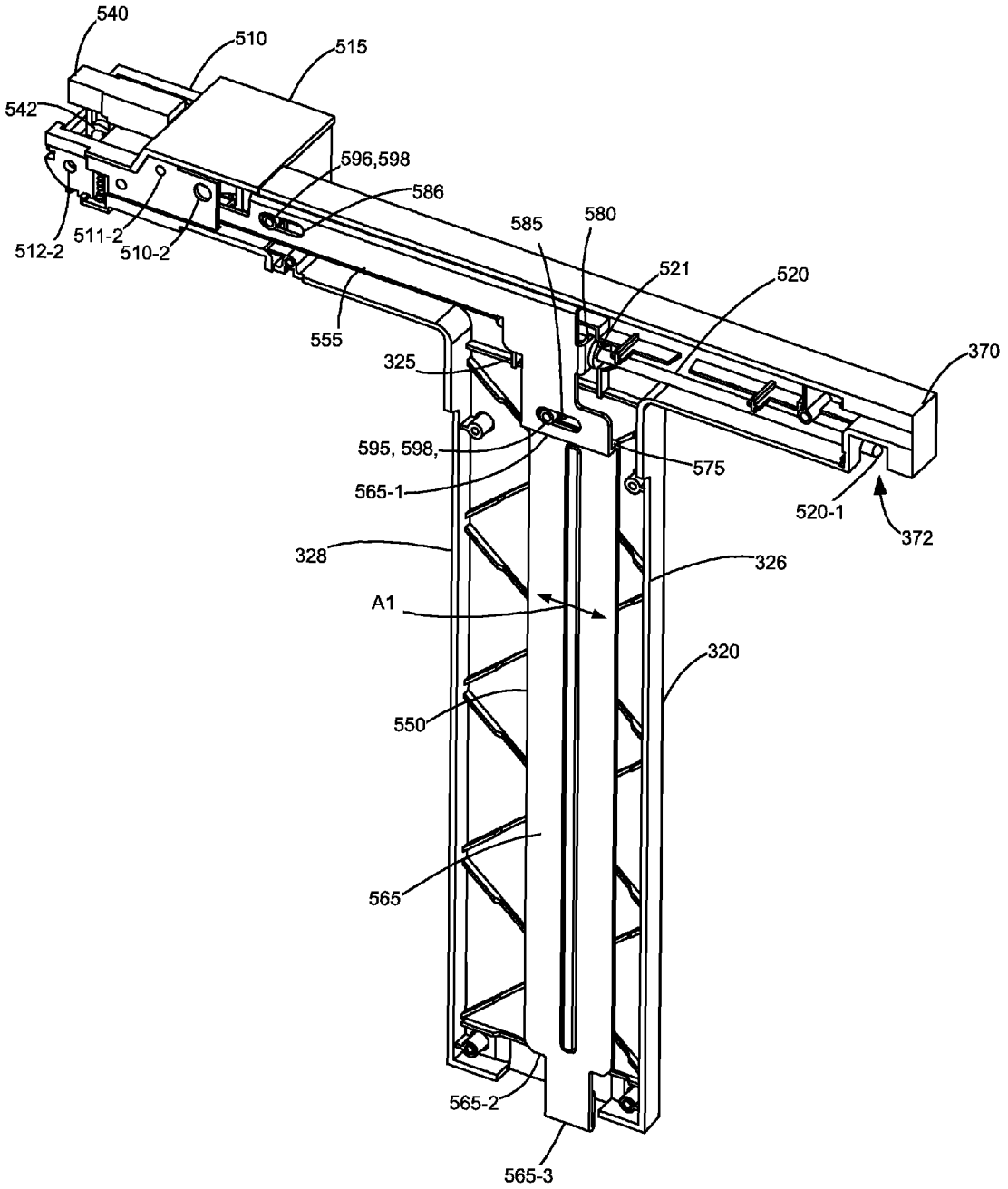
FIG. 9 is a rear view of the front plate and housing with respect to the latching assembly.
Figure 10A:
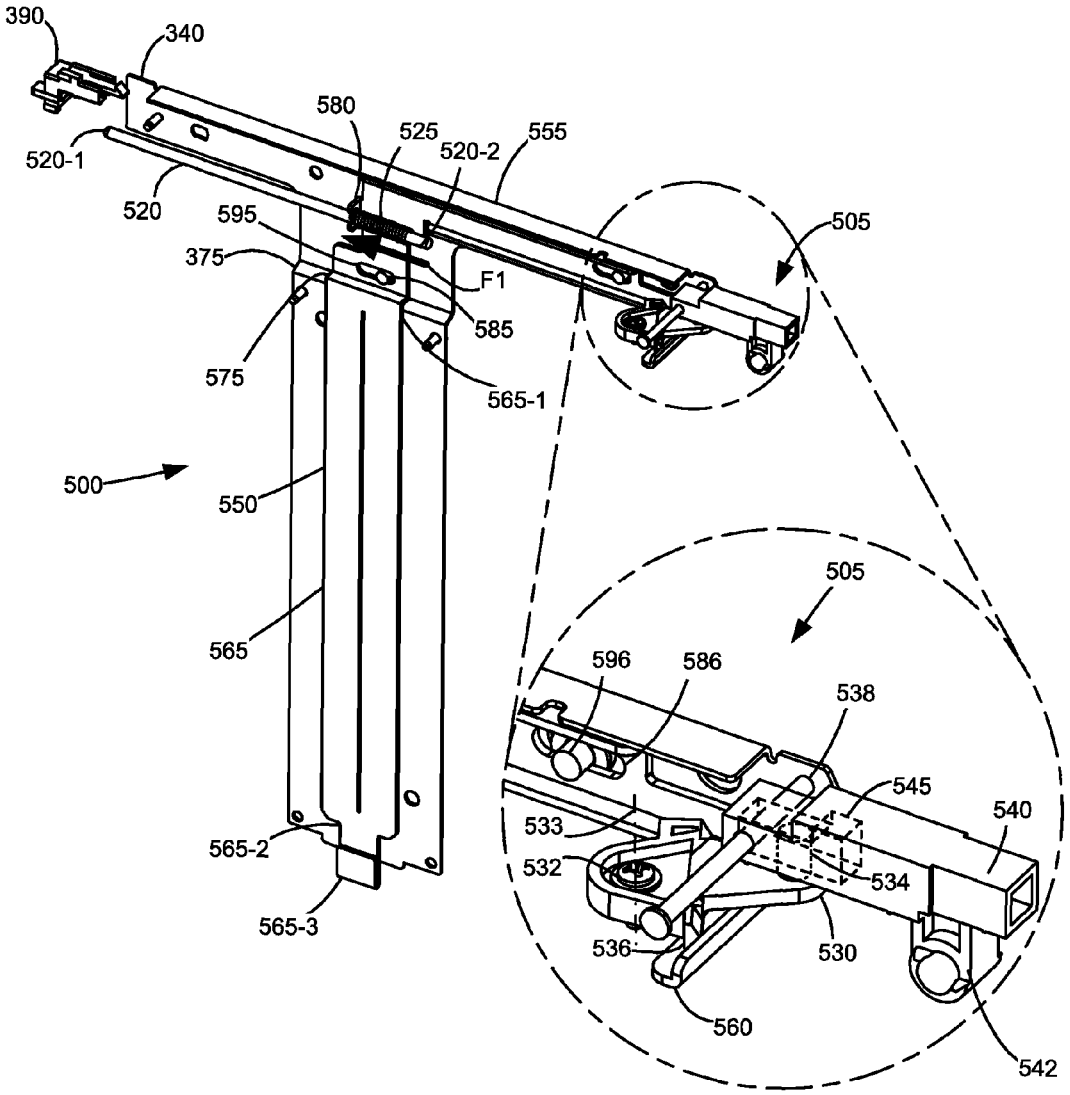
FIG. 10A-10B are perspective illustrations showing the operation of latching assembly mounted within rear media restraint where

FIG. 9 shows the relationship between latching assembly 500 and the T-shaped front plate 320 and housing 510. L-shaped member 550 is nested in front plate 230 and is translatable therein as indicated by the doubled headed arrow A1. The distal end 520-1 of side catch rod 520 extends into guide slot 372. L-shaped member 550 is shown in its latched positioned, and, when moved by actuation mechanism 505 to its second or unlatched state, L-shaped member 550 would translate to the left as viewed in FIG. 9 compressing spring 525 against spring stop 325.

Referring to FIGS. 10A-11C, operation of latching assembly 500 will be described. In FIGS. 10A-10B, example rear media restraint 300 is shown having latching assembly 500 mounted on the T-shaped back plate 340 with the T-shaped front plate 320 and housing 510 removed. In respective FIGS. 10A and 11A, latching L-shaped member 550 and actuation mechanism 505 are positioned in the latched state. Spring 525 applies a biasing force F1, indicated by arrow F1, to bracket 580 of L-shaped member 555 in a direction that is towards rear wall 130 as indicated by pins 595, 596 being located at the ends of slots 585, 586, respectively, closest to horizontal extension member 560 causing the first end 520-1 of catch rod 520 and bottom latch 565-3 to latch into one of the plurality of detents 135 of rear wall 130 and one of the plurality of indents 280 along track 250, respectively, when rear media restraint 300 is so positioned. As shown in FIG. 11A, actuation handle 540 is translated rearward adjacent to rear wall 510-2 of housing 510 moving pivot post 534 causing pivot member 530 to rotate toward rear wall 510-2 pivoting camming surface 536-1 pivot into contact with horizontal extension 560. Biasing spring 525 provides the force F1 necessary to keep actuation mechanism 505 and latching assembly 500 in the latched state which is the default position for the actuation mechanism 505 and latching assembly 500. Rear media restraint 330 is latched at a desired length position corresponding to a supported media type that would be present in media storage area 180.

Figure 11A:
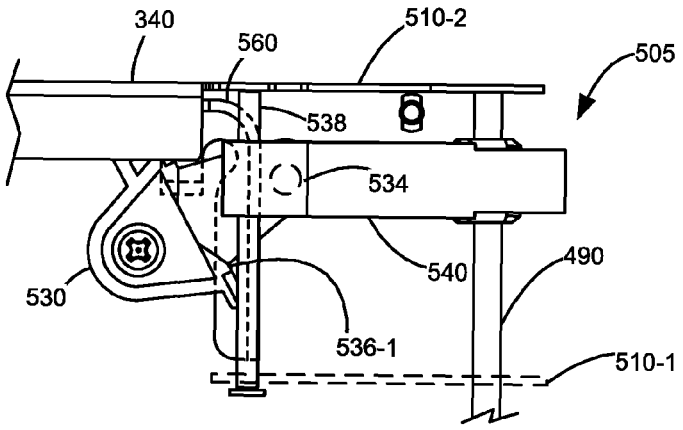
FIGS. 11A-11C illustrate operation of the latching assembly where
Figure 11B:
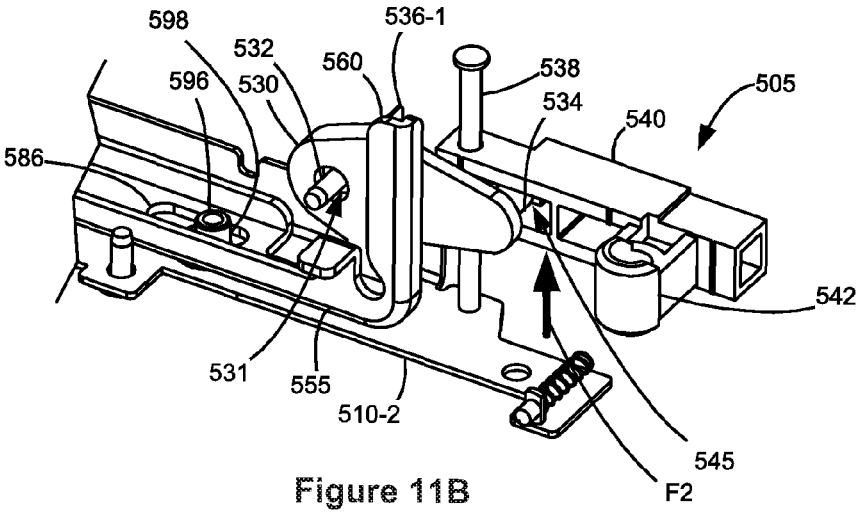

As shown in FIG. 11B front wall 510-11 has been removed and actuation mechanism 505 is transitioning to the unlatched position due to the application of a user-supplied force, indicated by arrow F2, that is sufficient to overcome the biasing force F1 of spring 525. Pivot member 530 has pivoted away from rear wall 510-2 due to the forward translation of actuator 540 and actuation mechanism camming surfaces 536-1, 536-2 of pivot member 530 are parallel to horizontal extension member 560 (view of camming surface 536-2 is blocked by horizontal extension member 560). Actuator 540 of pivot member 530 is positioned midway on actuator guide rod 540 and L-shaped member 555 has moved toward pivot member 530 as indicated by pin 596 and sleeve 598 being positioned approximately in the middle of slot 586.

Figure 10B:
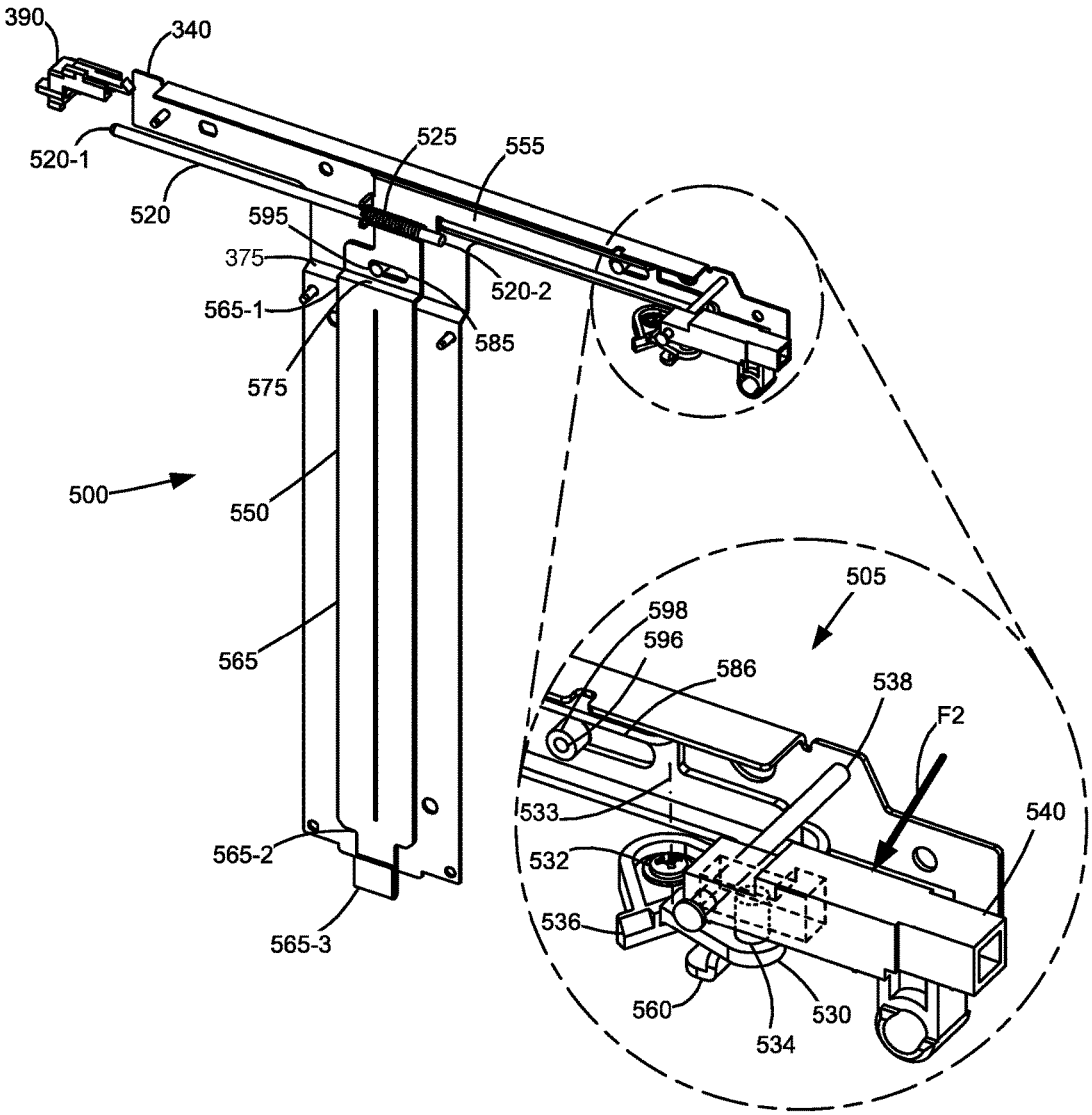
Figure 11C:
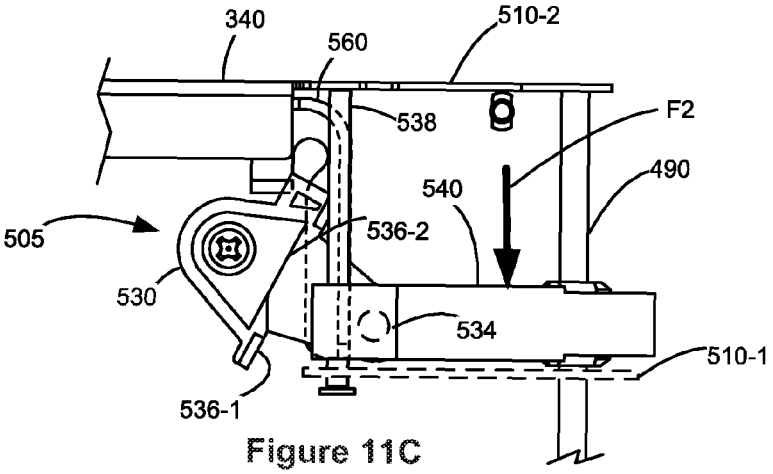

In FIGS. 10B and 11C, example rear media restraint 330 is shown in an unlatched position. The application of force F2 has continued the translation of actuator 540 along actuator guide rod 538 toward the front wall 510-1 which, in turn, has continued the rotation of pivot member 530 away from rear wall 510-2 and has brought camming surface 536-2 into contact with horizontal extension member 560. L-shaped member 555 and catch rod 520 have translated out of the respective ones of the pluralities of indents and detents as indicated by pin 596 and sleeve 598 being position at the end of slot 586 that is farthest away from horizontal extension member 560. As one of skill in the art would recognize the lengths of slots 585, 586 are designed to ensure that latch 563-3 and first end 520-1 of catch rod 520 will be free of their respective indent and detent when actuator 540 is adjacent the front wall 510-1 of housing 510. When the user-applied force F2 is removed, biasing force F1 returns latching mechanism 505 and L-shaped member 550 to their respective default positions.

Figure 14:
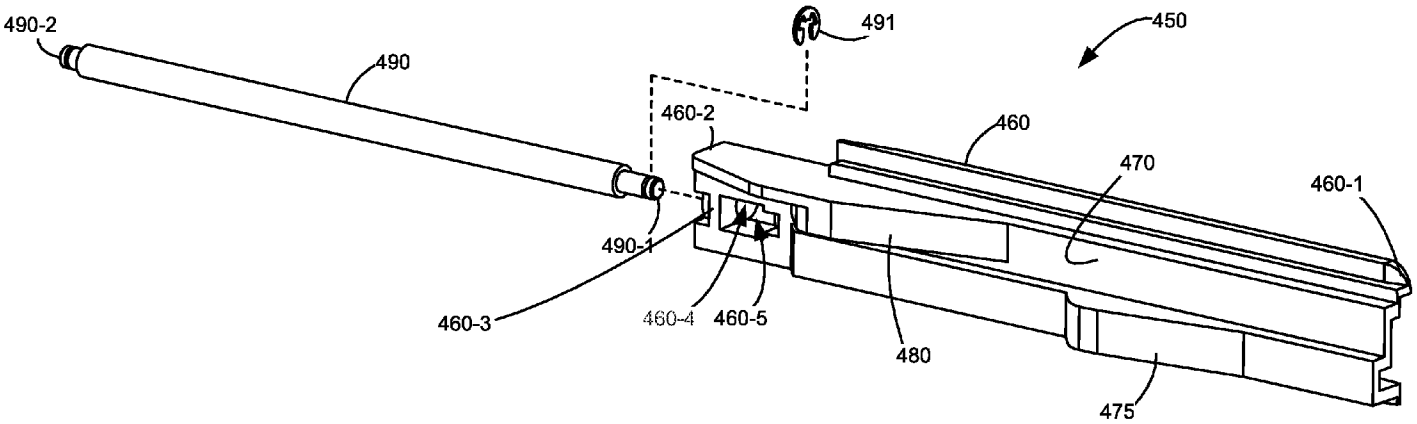
FIG. 14 is an exploded view of a camming assembly of the two-axis media guide system of FIG. 5.
Figure 15:
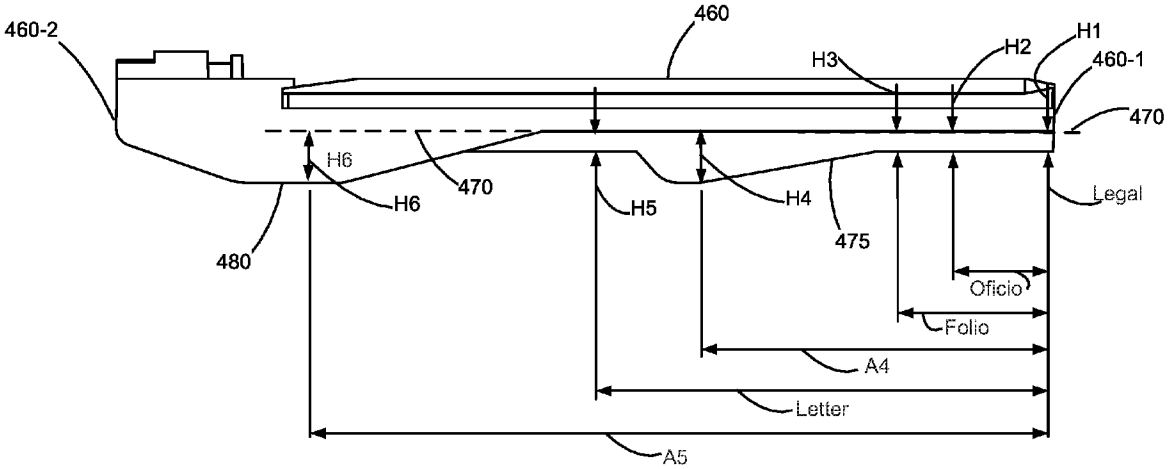
FIG. 15 is a top view of a camming member of the camming assembly of FIG. 14 showing the various heights of a camming profile surface for each supported media size.

With reference to FIGS. 14-15, example camming assembly 450 comprises a camming member 460 connected to a support rod 490 at a first end 490-1. A second end 490-2 of support rod 490 is passes through openings 514-1, 512-1 of housing 510 as it attached to rear wall 510-2 at opening 512-2 as previously described. Camming member 460 has a first and a second end 460-1, 460-2. First end 460-1 will be in contact with cam follower portions 418, 428 of first translation links 415, 425 in side media restraint 400 (see FIG. 16). An end wall 460-3 is provided at second end 460-2 and has an opening 460-4 in communication with a recess 460-5 provided in camming member 460. First end 490-1 of support rod is inserted through opening 460-4 into recess 460-5. A C-clip 491 is then attached to first end 490-1 of support rod 490 fixing support rod 490 to camming member 460. Support rod 490 and camming member 460 are moveable within a horizontal channel 126 provided along the top of front wall 120 (shown in FIG. 17).

Predefined camming profile surface 470 is formed on an inner surface of camming member 460. As shown camming profile surface 470 has first and second camming profile surfaces 475, 480 that are shown vertically offset. As described later, lower camming profile surface 475 engages with translation link 415 of side media restraint 400 while upper camming profile surface 480 engages with transition link 425 of side media restraint, which translation links 415, 425 are similarly vertically offset to align with their respective camming profile surfaces. The two camming profile surfaces 475, 480 provide a plurality of heights with each height corresponding to a media width of a given media type. Six example heights H1-H6 are shown and are measured with reference to camming profile surface 470 indicated by the dashed line in FIG. 15. The media types Legal, Oficio, Folio, A4, Letter, and A5 are associated with heights H1-H6, respectively. In the example embodiment shown, first or lower camming profile surface 475 supports media sizes Legal, Oficio, Folio, A4, and Letter, as indicated, with corresponding to heights H1-H5, respectively, and second camming profile surface 480 supports media size A5 corresponding to height H6. For the illustrated media types heights H1, H2, H3 and H5 are approximately equal, height H6 being the next highest and height H5 being the highest meaning that media size A4 has the narrowest width of the six example media types. The number of heights used is a matter of the number of designed-for media types and is a matter of design choice and not of limitation. Fewer and more heights may be used.

With reference to FIGS. 16-21, example side media restraint 400 and its mounting in front wall 120 is shown. Side media restraint 400 comprises a restraint assembly 401 having a translation assembly 402 mounted thereto. Restraint assembly 401 has a first vertical member 410 and a second vertical member 420 connected by a cross members 430 positioned near the tops and bottoms of vertical members 410, 420. Vertical members 410, 420 have top ends 410-1, 420-1, and bottom ends 410-2, 420-2. Recesses 410-4, 420-4 are provided in top portions 410-3, 420-3, respectively, for mounting spring-biased bumpers 411, 421. Upper and lower springs 412U, 412L are mounted in recess 410-4 while upper and lower springs 413U, 413L are mounted in recess 420-4. Bumpers 411, 421 are then mounted into recesses 410-4, 420-4, respectively. In combination with translation assembly 402, restraint assembly 401 acts to bias side edges of a media sheets in the media stack towards the media side edge reference surface 130-1 of rear wall 130 with spring-biased bumpers 411, 412 providing additional biasing of the topmost media sheets in the media stack.

Posts 435, 445 are provided at tops ends 411, 421 and posts 436, 446 are provided at bottom ends 412, 422 of vertical members 410, 420, respectively. A stop 445-1 is provided on post 445 having a height that is less than that of post 445. Post 445 is longer than post 435. Stop 445-1 allows translation link 425 to be vertically offset from translation link 415 which is at a height H10 from translation link 425 while translation link 425 is at a height H20 from translation link 426 where H20 is greater than H10. Translation links 416 and 426 are horizontally aligned with one another.

Translation assembly 402 includes at least one translation link. Two upper translation links 415, 425 are shown. Upper translation links 415, 425 include first ends 415-1, 425-1 having respective opening 415-4, 425-4 for pivotally mounting links 415, 425 to respective posts 435, 445 of the first and second vertical members 410, 420. Second ends 415-2, 425-2 have cam follower portions 418, 428, respectively, that will engage with camming surface 470, and in particular with cam profile surfaces 475, 480, respectively. Openings 415-5, 425-5 are also positioned near second ends 415-2, 425-2, respectively. Bottom translation links 416, 426 are substantially the same as upper translation links 415, 425. Openings 416-5, 426-5 near second ends 416-2, 426-2, respectively are aligned with opening 415-5, 425-5, respectively. Openings 416-4, 426-4 adjacent first ends 416-1, 426-1 are used to pivotally mount translation links 416, 426 to posts 436, 446 of the first and second vertical members 410, 420, respectively. Fasteners 499 are used to secure translations links 415, 416, 425, 426 to posts 435, 436, 445, 446, respectively.

A shaft 417 having first and second ends 417-1, 417-2 connects the top and bottom pivot links 415, 416 by passing through the openings 415-5, 416-5 of the top and bottom translation links 415, 416, respectively. A torsion spring 419 is pressed onto the first end 417-1 of shaft 417 and has a spring end 419-1 mounted to front wall 120 for biasing cam follower portion 418 of top pivot link 415 to contact camming member 460. Similarly, second vertical member 420 includes a shaft 427 having first and second ends 427-1, 427-2 that connects the top and bottom pivot links 425, 426 by passing through the openings 425-5, 426-5, of the top and bottom pivot links 425, 426. Shaft 417 couples translations links 415, 416 together while shaft 427 couples translation links 425, 426 together.

Figure 17:
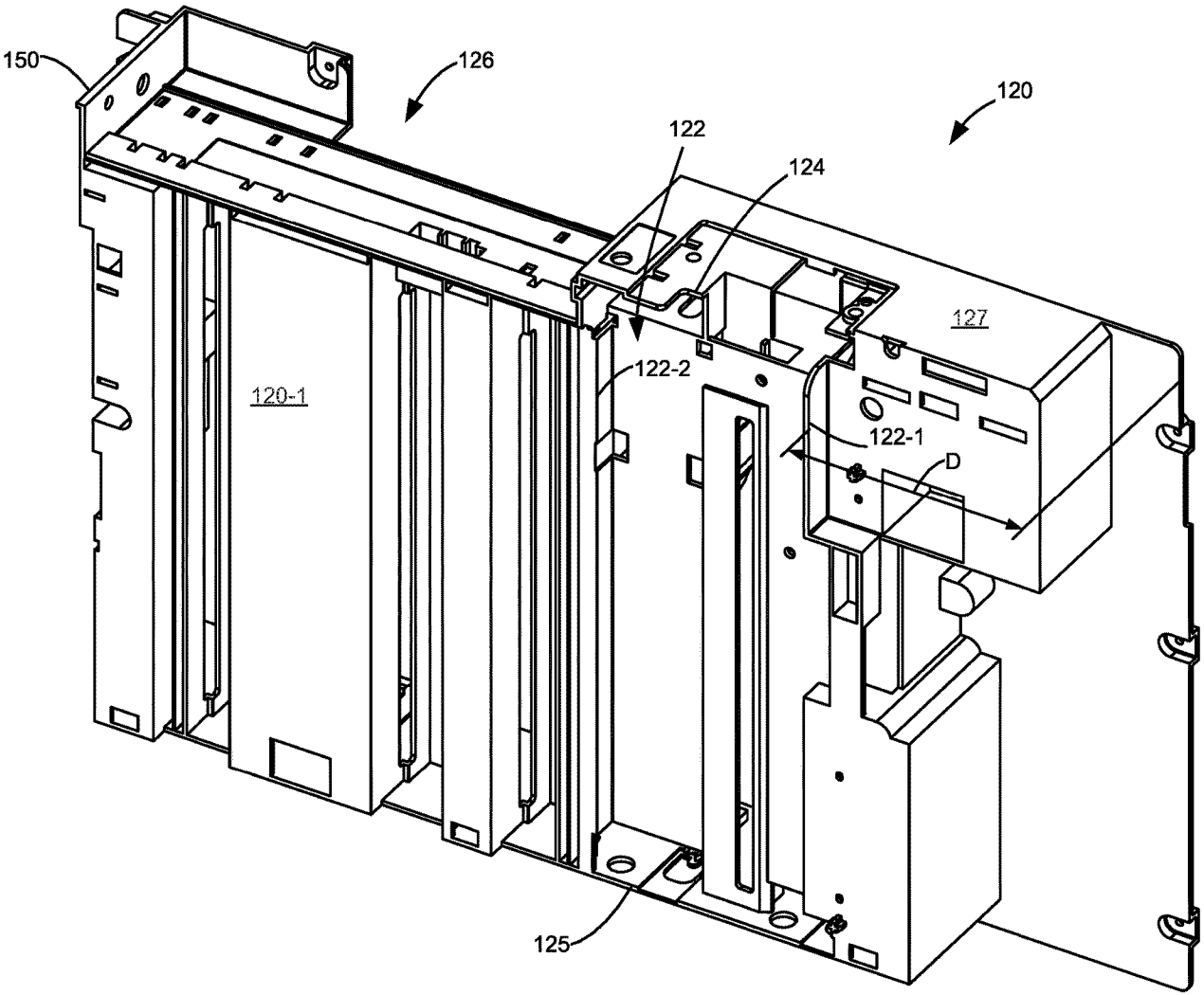
FIG. 17 illustrates the channels and associated features for the mounting of the side media restraint of FIG. 16 in the front wall of the removable media tray.
Figure 18:
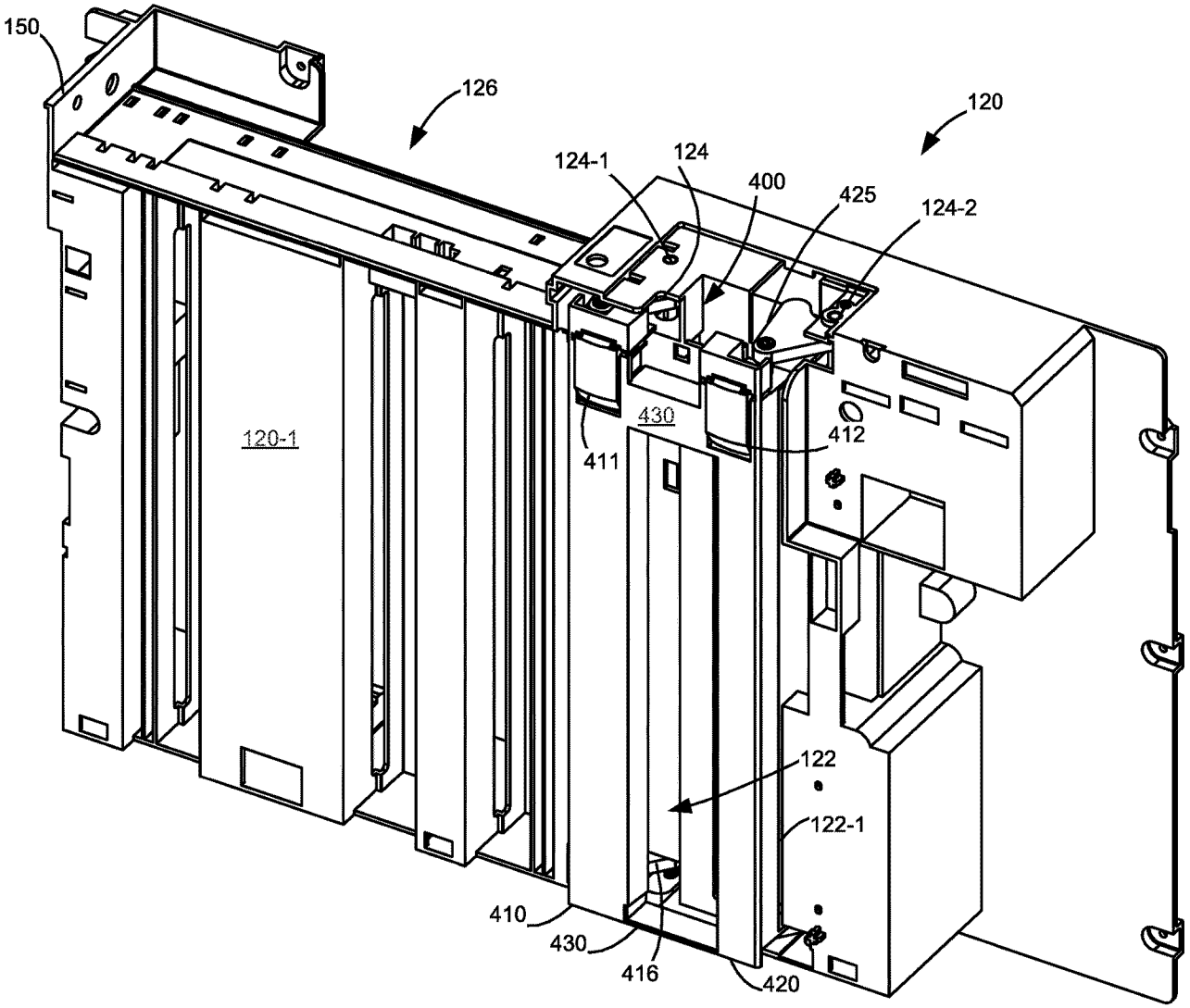
FIG. 18 illustrates the mounting of side media restraint of FIG. 16 in the front wall shown in FIG. 17 of the removable media tray.
Figure 19:
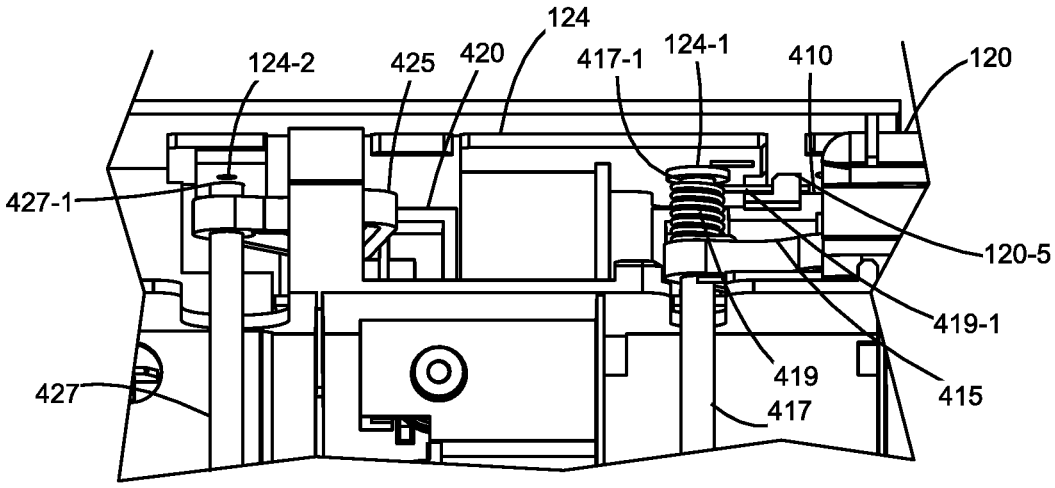
FIGS. 19-20 illustrate the upper and lower mounting arrangements of the side media restraint of FIG. 16.
Figure 20:
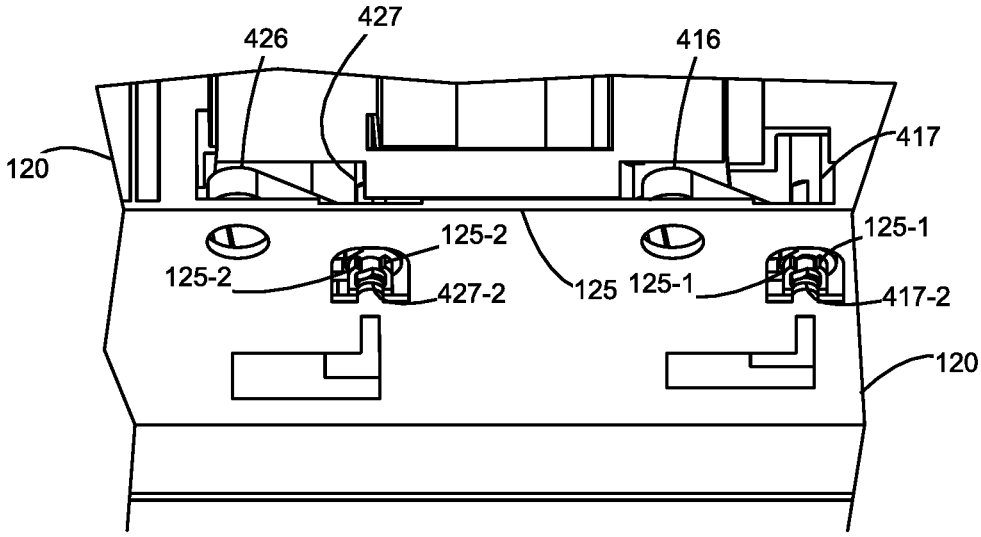

As shown in FIG. 17, the inner surface 120-1 of front wall 120 is shown having first vertical channel 122 extending the height of front wall 120 receives side media restraint 400 and channel 126 for camming assembly 450. Channel 122 is enclosed at the top and bottom ends by top end wall 124 and bottom end wall 125. The forward edge 122-1 of channel 122 is at a predetermined distance D from left side wall 140. A horizontal channel 126 along a top portion of front wall 120 extends from right side wall 150 toward left side wall 140. Portions of channel 126 that extend forward of channel 122 are covered by a panel 127. Channel 126 receives camming assembly 450. Channel 126 has a length sufficient to allow camming member 460 to extend forward of side media restrain 400 when rear media restraint 300 is at its most forward position with respect to leading edge media reference surface 140-1. Channel 122 is located such that side media restraint 400 is located adjacent to the leading edge of all supported media types used with removable media tray 100. With reference to FIG. 18, side media restraint 400 is shown translateably movably mounted in first channel 122 and is translatable in a direction transverse to front wall 120. With reference to FIG. 19, top pivot link 425 of second vertical member 420 is positioned vertically offset from top pivot link 415 of first vertical member 410. Each of the first ends 417-1, 427-1 of shafts 417, 427 are inserted into corresponding openings 124-1, 124-2 located at a top end wall 124 provided as part of front wall 120. Spring end 419-1 is held against spring stop 120-5 provided on front wall 120. With reference to FIG. 20, bottom pivot links 416, 426 are shown to be positioned horizontally aligned to one another. Each of the second ends 417-2, 427-2 of shafts 417, 427 are inserted into spring arm pairs 125-1, 125-2 located at a bottom end wall 125 provided as part of front wall 120.

Figure 21:
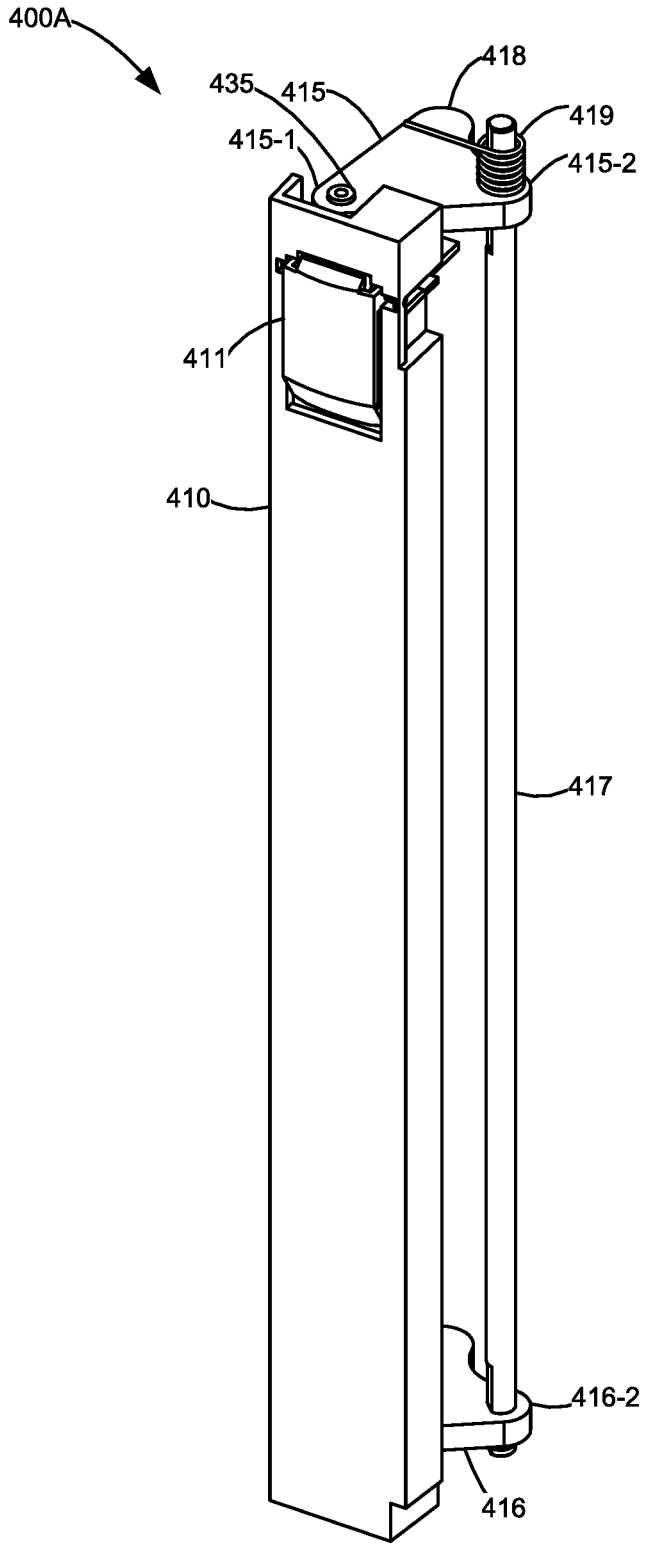
FIG. 21 is a perspective view of an alternate embodiment of a side media restraint of the two-axis media guide system of FIG. 5 having only a single vertical member.

FIG. 21 illustrates an alternate embodiment showing side media restraint 400A.

Side media restraint 400A comprises a restraint assembly 401A having a translation assembly 402A mounted thereto. Restraint assembly 401A and translation assembly 402A are substantially the same as restraint assembly 401 and translation assembly 402 except that restraint assembly 401 has a single vertical member 410 and translation assembly 402A has only one set of upper and lower translation links 415, 416 connected by shaft 417 as previously described. Upper translation link 415 is mounted at is first end 415-1 to post 435 on vertical member 410. The second end 415-2 of upper translation link 415 has cam follower portion 418 that will engage with camming surface 470. A torsion spring 419 is pressed onto the upper end of shaft 417 for biasing the translation assembly 402A toward camming member 460. A spring-biased bumper 411, as previously described, is also provided adjacent the upper end of vertical member 410.

Operation of two-axis media guide system 350 per supported media length will be briefly explained with reference to FIGS. 22-27. In these figures rear media restraint 300 is moved from its position for the longest designed-for media type to the shortest going through several positions for media types having intermediate lengths. Should FIGS. 22-27 be flipped the movement of rear media restraint 300 toward left side wall 140 and the related movement of side media restraint 400 toward rear wall 130 may be seen.

Figure 22:
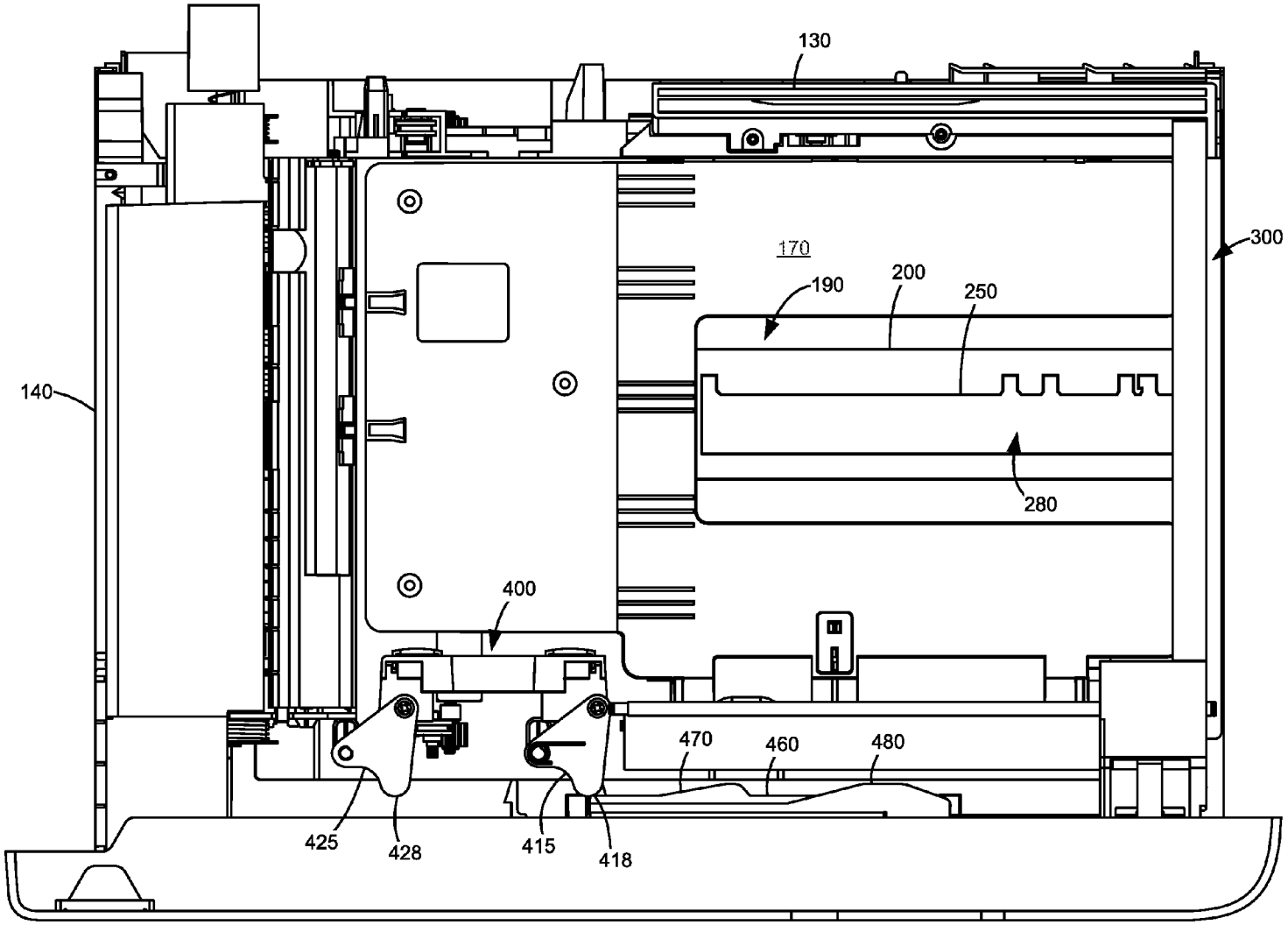
FIGS. 22-27 are top views of the removable media tray of FIG. 2 showing the positioning of the two-axis media guide system for six example designed-for media sizes where

Referring to FIG. 22, with rear media restraint 300 positioned at the longest designed-for media length, which for purposes of illustration only is Legal, first cam follower portion 418 engages with camming member 460 at its first end 460-1. In FIG. 22, rear media restraint 300 is shown to be latched into indent 280-1 along track 250 of bottom plate 200 and into detent 135-1 of rear wall 130. Side media restraint 400 is positioned in a first position with respect to rear wall 130 with cam follower portion 418 of the top pivot link 415 contacting the predetermined height H1 of the first camming profile surface 470 for the "Legal" media type shown in FIG. 15. In this configuration, rear and side media restrains 300, 400, respectively, support the Legal media type.

As rear media restrain 300 is moved forward to shorter designed-for media lengths, cam follower portion 418 travels along the first camming profile surface 470 causing the top pivot link 415 of the first vertical member 410 to translate side media restraint 400 in a direction transverse to the front wall 120. Eventually as the shorter media type positions are reached, the second cam follower portion 428 engages with camming member 460 and travels along the second camming profile surface 480 causing the top pivot link 425 of the second vertical member 420 to translate side media restraint 400 in a direction transverse to the front wall 120 as rear media restraint 300 approaches the shortest designed-for media length.

Figure 23:
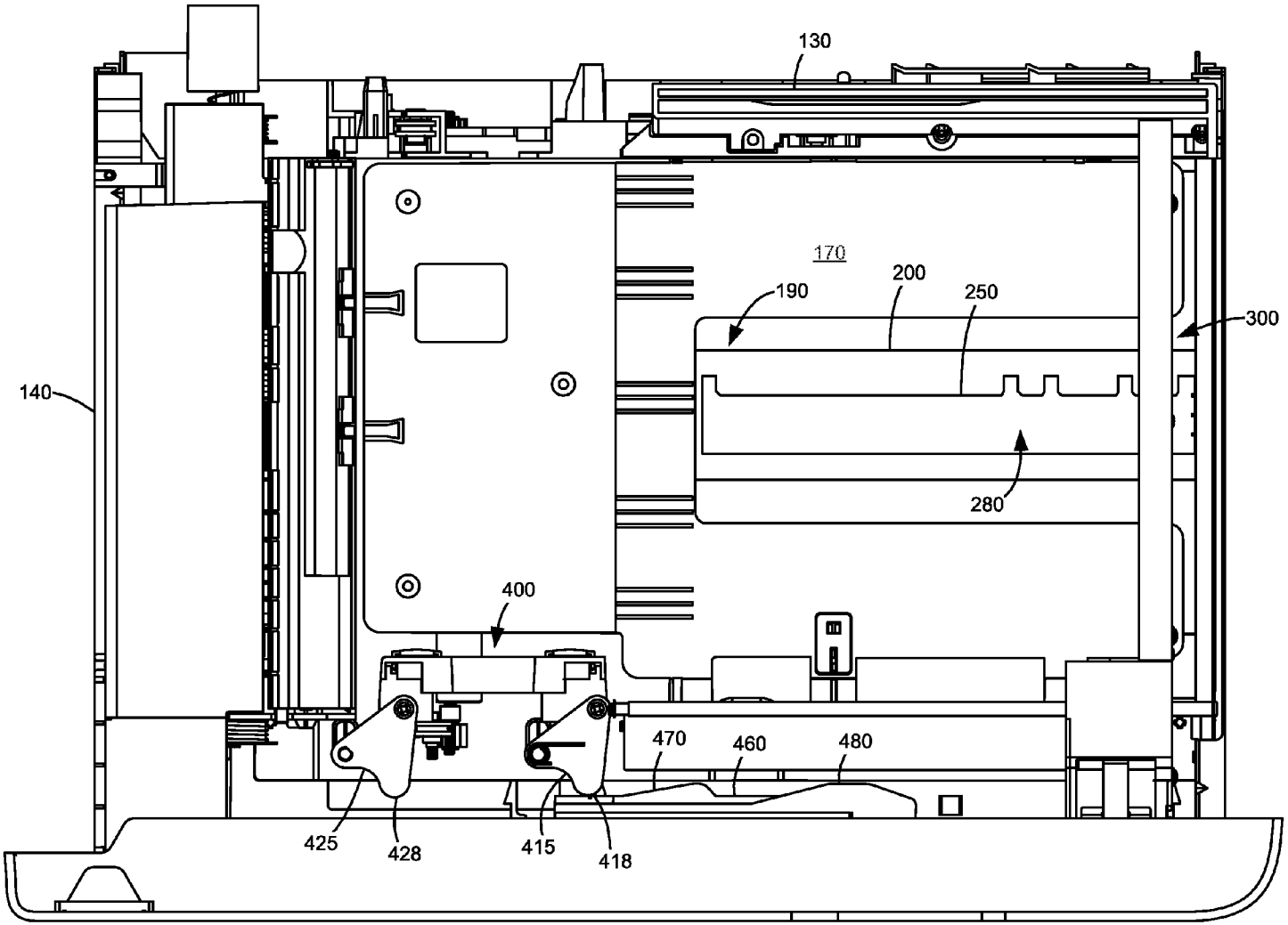

In FIG. 23, rear media restraint 300 has been moved towards left side wall 140 and is shown latched into indent 280-2 along track 250 and into detent 135-2 of rear wall 130. Side media restraint 400 is still positioned in the first position with respect to rear wall 130. Cam follower portion 418 of the top pivot link 415 travels along first camming profile surface 470 to the travel distance shown in FIG. 15 as "Oficio" and contacts it at the predetermined height H2. In this configuration, rear and side media restraints 300, 400, respectively, support the Oficio media type.

Figure 24:
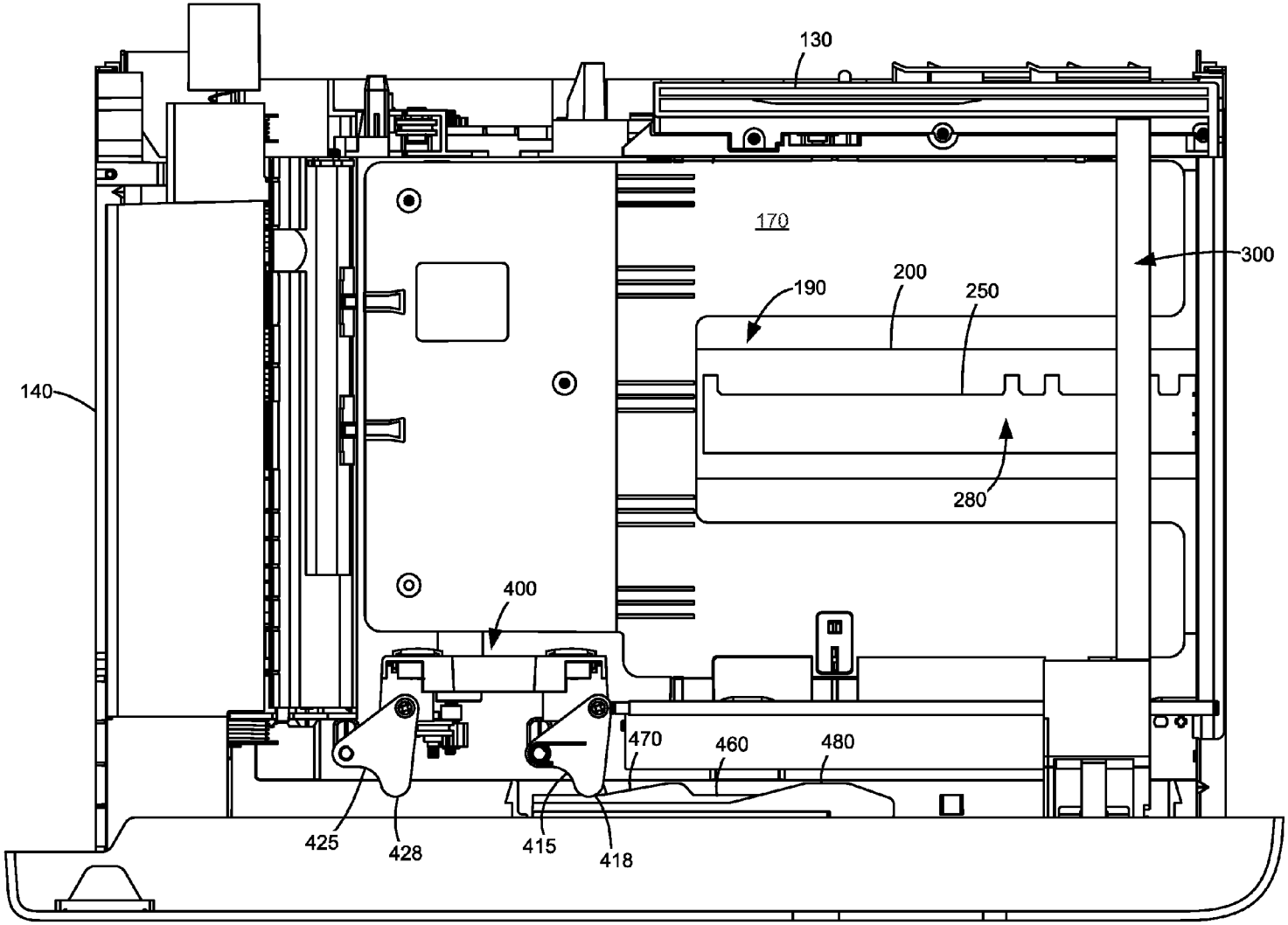

In FIG. 24, rear media restraint 300 has been moved further towards left side wall 140 and is shown latched into indent 280-3 along track 250 and into detent 135-3 of rear wall 130. Side media restraint 400 is still positioned in a first position with respect to rear wall 130. Cam follower portion 418 of the top pivot link 415 travels further along first camming profile surface 470 the travel distance shown in FIG. 15 as "Folio" and contacts it the predetermined height H3. In this configuration, rear and side media restraints 300, 400, respectively, support the Folio media type.

Figure 25:
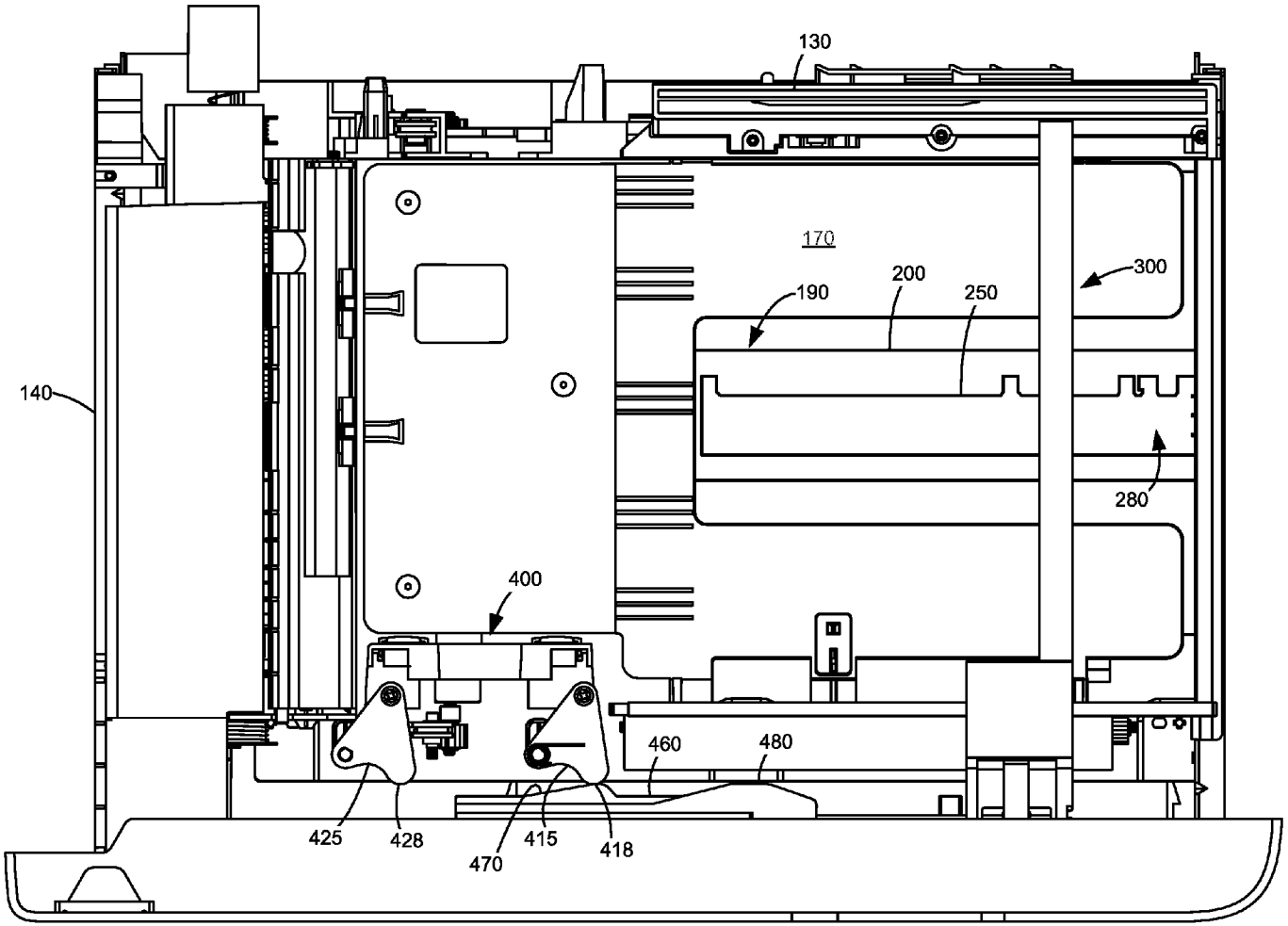

In FIG. 25, rear media restraint 300 has been moved further towards left side wall 140 and is shown latched into indent 280-4 of track 250 and into detent 135-4 of rear wall 130. Side media restraint 400 is translated further toward rear wall 130. Cam follower portion 418 of the top pivot link 415 travels further along first camming profile surface 470 the travel distance shown in FIG. 14 as "A4" and contacts the predetermined height H4 of camming member 460. In this configuration, rear and side media restraints 300, 400, respectively, support the A4 media type.

Figure 26:
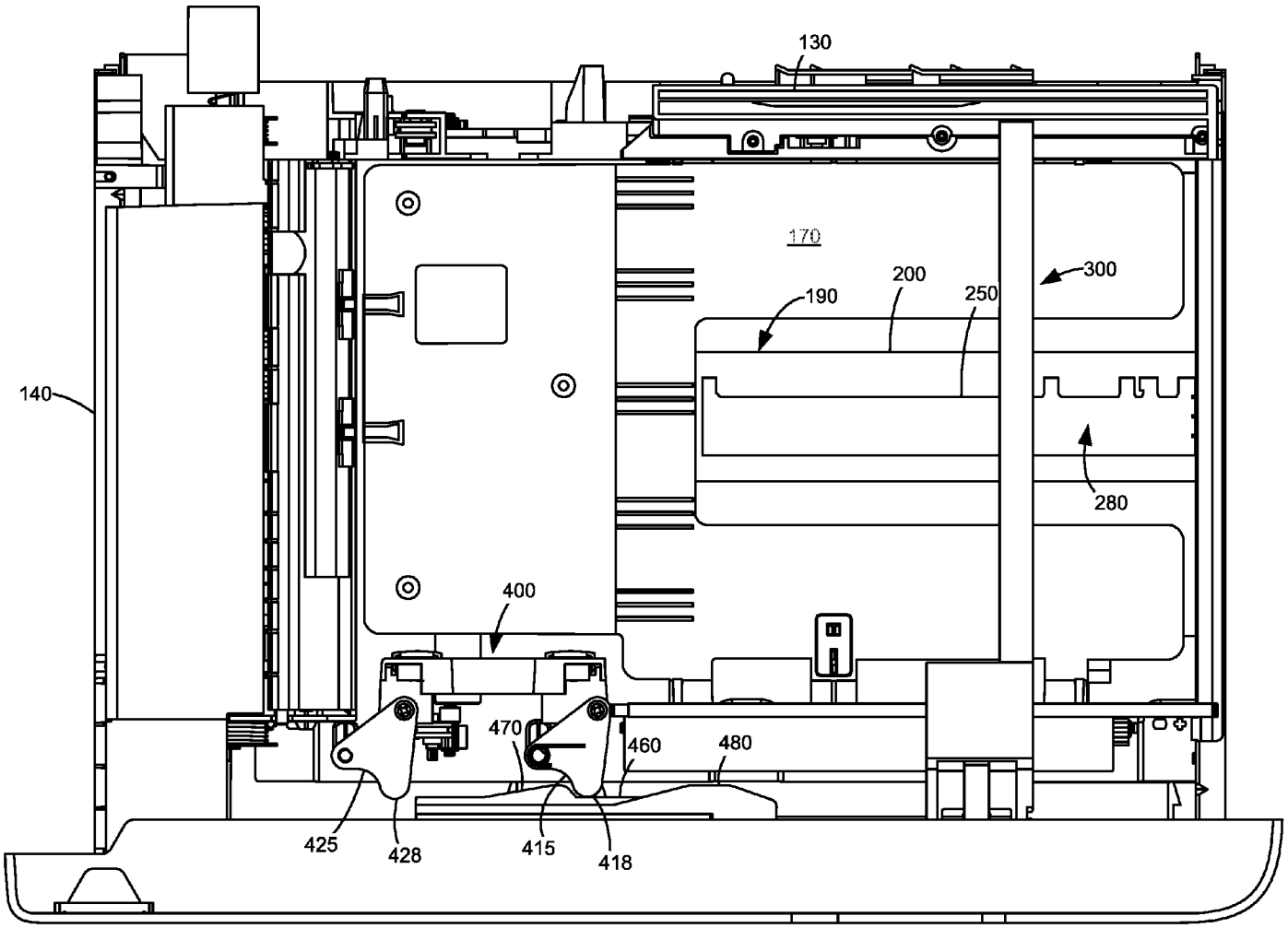

In FIG. 26, rear media restraint 300 is shown to be actuated further towards left side wall 140 and is shown latched into indent 280-5 of track 250 and into detent 135-5 of rear wall 130. Side media restraint 400 has translated back to the first position. Cam follower portion 418 of the top pivot link 415 has traveled along first camming profile surface 470 the travel distance shown in FIG. 15 as "Letter" and has contacted the predetermined height H5 of camming member 460. In this configuration, rear and side media restraints 300, 400, respectively, support the Letter media type.

Figure 27:
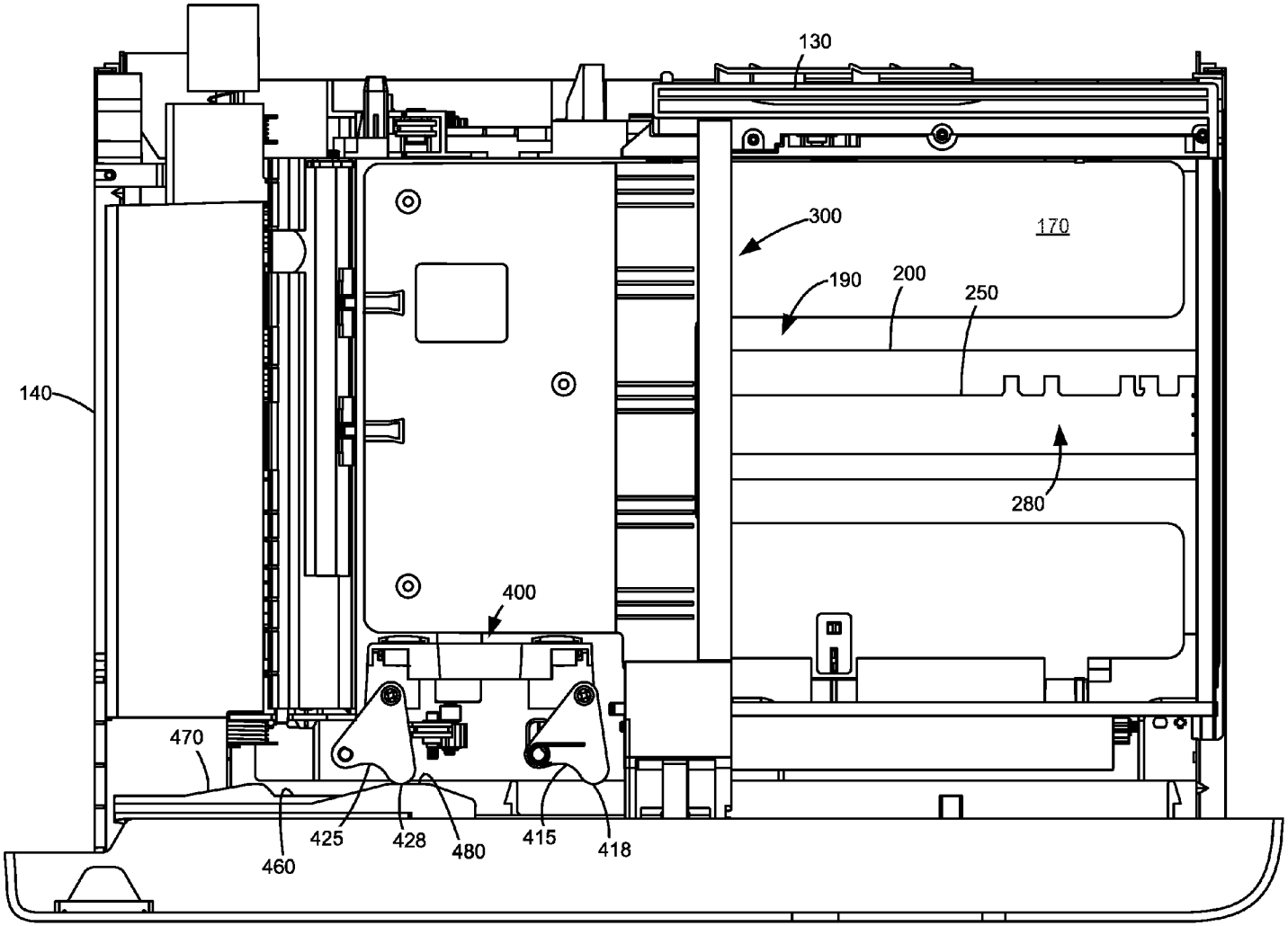

In FIG. 27, rear media restraint 300 has being positioned at its closest distance towards left side wall 140 and is shown latched into indent 280-6 of track 250 and into detent 135-6 of rear wall 130. Side media restraint 400 is translated towards the second position. Cam follower portion 428 of the top pivot link 425 has traveled along second camming profile surface 480 the travel distance shown in FIG. 15 as "A5" and now contacts the predetermined height H6 of camming member 460. In this configuration, rear and side media restraints 300, 400, respectively, support the A5 media type.

The foregoing description of several methods and an embodiment of the present disclosure have been presented for purposes of illustration. It is not intended to be exhaustive or to limit the present disclosure to the precise steps and/or forms disclosed, and obviously many modifications and variations are possible in light of the above description. It is intended that the scope of the present disclosure be defined by the claims appended hereto.

What is claimed is:

1. A media input tray for an imaging device, the media input tray comprising:

a first wall transverse to a media feed direction having an inner surface forming a leading edge media reference surface for a media stack;

a second wall parallel to the media feed direction having an inner surface forming a side edge media reference surface for the media stack, the first and second walls defining a media storage area; and, a two-axis media restraint system having a rear media restraint coupled to a side media restraint, the two-axis media restraint including:

the rear media restraint being adjustably mounted within the media input tray and moveable within the media storage area toward and away from the first wall over a predetermined range of travel to one of a plurality of selectable predetermined positions each spaced from the leading edge media reference surface, the rear media restraint having a latching assembly for slidably latching with the media input tray at a selected one of the plurality of selectable predetermined positions and having a first state latched to the media input tray, and, when actuated, a second state unlatched from the media input tray allowing the rear media restraint to be moved within the predetermined range of travel;

the side media restraint mounted within the media input tray in the media storage area opposite to the side edge media reference surface, the side media restraint moveable in a direction transverse to the media feed direction and the side edge media reference surface as the rear media restraint travels to one of the plurality of selectable predetermined positions, the side media restraint including:

a first vertical member for contacting a side edge of a media stack, the first vertical member having a top and a bottom end; and, a translating assembly having:

a first translation link having a first end and an opposed second end, the first end of the first translation link pivotally attached to the top end of the first vertical member, the first translation link having a first cam follower portion adjacent the second end thereof; and, a biasing member operatively coupled between the first translation link and the media input tray for biasing the camming portion of translation link toward a camming member;

and, the camming member having a predefined camming profile surface, the camming member coupled to and moveable with the rear media restraint and slidably engaged with the cam follower portion of the first translation member when the rear media restraint is within the predetermined range of travel, wherein, with the latching assembly in the second state and upon movement of the rear media restraint within the predefined range of travel, the camming member moves with the rear media restraint in the same direction and the first cam follower portion of the first translation link travels along the camming profile surface causing the first translation link to move the side media restraint transversely to the side edge media reference surface with a position of the side media restraint dependent upon a position of the cam follower portion of the first translation link on the predefined camming profile surface.

2. The media input tray of claim 1 wherein, the plurality of selectable predetermined positions correspond to media lengths for A5 media, Letter media, A4 media, Folio media, Oficio media, and Legal media.

3. The media input tray of claim 1 wherein:

the media input tray includes a bottom having a plurality of indents corresponding to the plurality of selectable predetermined positions of the rear media restraint; and, the rear media restraint further comprises:

a support plate; and, a front plate attached to the support plate forming a housing for the latching assembly, an outer face of the front plate providing a media restraint surface;

and, the latching assembly comprises:

a frame attached to the housing;

an actuator mounted on the frame; and, a spring-biased latch arm slidably coupled to the housing and operatively coupled to the actuator and having a catch sized to be received into each indent in the plurality of indents, the latch arm and catch biased toward the plurality of indents and movable away from the indents by the actuator, wherein, with the latching assembly in the first state, the catch engages one of the plurality of indents to latch the rear media restraint at a corresponding one of the plurality of selectable predetermined positions, and, with the latching assembly in the second state, the actuator moves the latch arm and catch away from the engaged one of the plurality of indents, thereby allowing the rear media restraint to move along the track.

4. The media input tray of claim 1 wherein:

the side edge media reference surface has a plurality of detents corresponding to the plurality of selectable predetermined positions of the rear media restraint; and, the latching arm is coupled to a catch rod having a free end sized to be received in each of the plurality of detents, wherein, with the rear media restraint located at one of the plurality of selectable predetermined positions and when the latching assembly is in the first state, the free end of the catch rod is received in one of the plurality of detents corresponding to the one of the plurality of selectable predetermined positions.

5. The media input tray of claim 1 wherein, the first vertical member includes a spring-biased bumper mounted within an upper portion thereof.

6. The media input tray of claim 1 wherein:

the side media restraint includes a second vertical member having a top and a bottom end, the second vertical member positioned parallel to and spaced from the first vertical member;

the translation assembly includes a second translation link having a first end and an opposed second end, the first end of the second translation link rotatably attached to the top end of the second vertical member, the second translation link having a second cam follower portion adjacent the second end thereof; and, at least one cross member interconnecting the first and second vertical members together.

7. The media input tray of claim 6 wherein, the predefined camming profile surface further includes a first camming profile surface engageable with the first cam follower portion and a second camming profile surface engageable with the second cam follower portion, each of the first and second camming profile surfaces having a plurality of heights along a length thereof in a direction transverse to a motion of the camming member and each of the plurality of heights corresponding to a media width, such that as one of the first and second cam follower portions contacts one of the plurality of heights of the first and second camming profiles, respectively, the side media restraint moves to a position corresponding to the media width associated with the contacted one of the plurality of heights.

8. The media input tray of claim 6 wherein, each of the first and second vertical members includes a spring-biased bumper mounted within respective upper portions thereof.

9. An elevator-style media drawer for an imaging device, the media drawer comprising:

a front wall and a rear wall connected by opposed first and second side walls, each wall depending from a bottom plate forming a media storage area for a media stack, the bottom plate having on an upper surface a track having a plurality of indents and extending from the first side wall toward the second side wall parallel to the front and rear walls, the front wall having a first vertical channel at a predetermined distance from the first side wall and a horizontal channel therein extending from the first side wall toward the first vertical channel;

an elevator plate for supporting the media stack and positioned parallel to and above the bottom plate in the media storage area, the elevator plate having a U-shaped opening having an open end adjacent the first side wall and a closed end spaced at a predetermined distance from the second side wall;

a lift mechanism operatively coupled to the elevator plate for raising and lowering the elevator plate and, when present, the media stack; and, a two-axis media restraint system having a user-actuated rear media restraint operatively connected via a camming member to a side media restraint, the two-axis media restraint system including:

the user-actuated rear media restraint for restraining a rear edge of the stack media when present, the rear media restraint having a latching assembly for slidably engaging with one of the plurality of indents and having a first state latched to the track, and, when actuated, a second state unlatched from the track allowing the rear media restraint to slide along the track, the rear media restraint positioned parallel to the first side wall and moveable within the U-shaped opening of the elevator plate among a plurality of positions corresponding to a plurality of designed-for media lengths including a position corresponding to a shortest designed-for media length and a position corresponding to a longest designed-for media length;

the side media restraint slidably mounted to the front wall at a predetermined position from the second side wall and translatable into the media storage area, the side media restraint including:

a first vertical member for contacting a side edge of the media stack slidably mounted within the first vertical channel, the first vertical member having a top and a bottom end; and, a translation assembly including:

a first translation link having a first end and an opposed second end, the first end of the first translation link pivotally attached to one of the top and bottom ends of the first vertical member, the first translation link having a first cam follower portion adjacent a second end thereof; and, a biasing member operatively coupled between the first translation link and the front wall for biasing the first cam follower portion of the first translation link toward the camming member;

and, the camming member having a predefined camming profile surface and movable within the horizontal channel of the front wall, the camming member coupled to and moveable with the rear media restraint and slidably engaged with the first cam follower portion of the first translation link;

wherein, upon movement of the rear media restraint along the track on the bottom plate, the camming member moves with the rear media restraint in the same direction and the first cam follower portion of the first translation link follows the camming profile surface with the first translation link translating the first vertical member of the side media restraint in a direction transverse to the front wall as the first cam follower portion of the first translation link travels on the camming profile surface.

10. The elevator-style media drawer of claim 9 wherein, the first vertical member includes a spring-biased bumper mounted within an upper portion thereof.

11. The elevator-style media drawer of claim 9 wherein, the translation assembly further includes a second translation link having a first end rotatably mounted to the other of the top and bottom ends of the first vertical member and a connection rod interconnecting the first and second translation links.

12. The elevator-style media drawer of claim 9 wherein, the latching assembly further includes a side catch, and the rear wall includes a plurality of detents each sized for receiving the side catch when the latching assembly is in a latched state, each of the plurality of detents being at a location on the rear wall corresponding to the position of the rear media restraint when located at each designed-for media length in the plurality of designed-for media lengths.

13. The elevator-style media drawer of claim 9 wherein:

the rear media restraint further comprises, a support plate; and, a front plate attached to the support plate forming a housing for the latching assembly, an outer face of the front plate providing a media restraint surface;

and, the latching assembly comprises:

a frame attached to the housing;

an actuator mounted on the frame; and, a spring-biased latch arm slidably coupled to the housing and operatively coupled to the actuator and having a catch sized to be received into each indent in the plurality of indents, the latch arm and the catch biased toward the plurality of indents and movable away from the plurality of indents by the actuator wherein, with the latching assembly in the first state, the catch engages one of the plurality of indents to latch the rear media restraint at a corresponding one of the plurality of predetermined positions, and, with the latching assembly in the second state, the actuator moves the latch arm and catch away from the engaged one of the plurality of indents, thereby allowing the rear media restraint to move along the track.

14. The elevator-style media drawer of claim 9 wherein:

a guide rod is mounted in the horizontal channel and the frame of the latching assembly is slidably mounted to the guide rod.

15. The elevator-style media drawer of claim 9 wherein:

the front wall further includes a second vertical channel positioned inboard of the first vertical channel; and, the side media restraint includes a second vertical member having a top and a bottom end, and slidably mounted in the second vertical channel;

the translation assembly includes a second translation link having a first end and an opposed second end, the first end of the second translation link rotatably attached to a corresponding one of the top and bottom ends of the second vertical member corresponding to one of the top and bottom ends of the first vertical member to which the first translation link is attached, the second translation link having a second cam follower portion adjacent the second end thereof; and, a cross member interconnecting the first and second vertical members together.

16. The elevator-style media drawer of claim 15, wherein the predefined camming profile surface further includes a first camming profile surface engageable with the first cam follower portion and a second camming profile surface engageable with the second cam follower portion, the first and second camming profile surfaces having a plurality of heights along a length thereof in a direction transverse to a motion of the camming member and each of the plurality of heights corresponding to a media width, such that as one of the first and second cam follower portions contacts one of the plurality of heights of the first and second camming profiles, respectively, the side media restraint moves to a position corresponding to the media width associated with the contacted one of the plurality of heights.

17. The elevator-style media drawer of claim 15 wherein, the first and second vertical members each include a spring-biased bumper mounted within respective upper portions thereof.

18. The elevator-style media drawer of claim 15 wherein, the translation assembly further includes:

a third translation link having a first end rotatably mounted to the other of the top and bottom ends of the first vertical member and a first connection rod interconnecting the first and third translation links; and, a fourth translation link having a first end rotatably mounted to the other of the top and bottom ends of the second vertical member and a second connection rod interconnecting the second and fourth translation links.

19. The elevator-style media drawer of claim 9 wherein:

the rear media restraint comprises:

a T-shaped support plate; and a T-shaped front plate attached to the T-shaped support plate forming a housing for the latching assembly;

and, the latching assembly includes:

a frame attached to an end of a top of one of the T-shaped front and support plates;

an inverted L-shaped latch arm having a top portion, a horizontal extension member, and a vertical portion, the top portion having a first and a second end positioned parallel to and slidably attached to the support plate, the horizontal extension portion depending perpendicularly from the first end of the top portion and received in the front plate, and the vertical portion extending downward from the second end of the top portion, a bottom end of the vertical portion forming a bottom catch slidably received into one of the plurality of indents;

a pivot member rotatably mounted to the frame inboard of the horizontal extension member of the latch member, the pivot member having a camming surface in contact with the horizontal extension member of the latch arm and a pivot post mounted at a second end of the pivot member outboard of the horizontal extension member of the latch arm;

a actuator guide rod mounted to the frame adjacent and parallel to the horizontal extension member of the latch member;

a handle slidably mounted on the actuator guide rod, the handle having an opening aligned with and receiving the pivot post; and, a bias spring mounted between the latch arm and the housing for biasing the latch arm toward the plurality of indents in the track, wherein, with the handle positioned adjacent a second end of the actuator guide rod and the latching assembly is in a latched state, upon application of a force sliding the handle toward the support plate, the pivot member rotates against the horizontal extension member of the latch member, translating the latch arm and bottom catch away from the plurality of indents allowing the rear media restraint to be translated, and, upon removing the force, the bias spring translates the latch arm back toward the plurality of indents which rotates the pivot member so as to return the handle to its position adjacent the second end of the actuator guide rod.

20. The elevator-style media drawer of claim 19, wherein the latching assembly of the rear media restraint further comprises:

a catch rod attached to the second end of the top portion and aligned therewith with a free end of the catch rod acting as a side wall catch received into one of a plurality of detents located along the rear wall when the latching assembly is in a latched state, each one of the plurality of detents being at a location on the rear wall corresponding to the position of the rear media restraint when located at each designed-for media length in the plurality of designed-for media lengths.

21. A two-axis media restraint assembly in an elevator-style media drawer for an imaging device, the media drawer comprising a front wall and a rear wall connected by opposed first and second side walls, each wall depending from a bottom plate forming a media storage area for holding a media stack, the bottom plate having a serrated track on an upper surface thereof extending from the first side wall toward the second side wall parallel to the front and rear walls, the front wall having a vertical channel positioned between the first and second side walls, the front and rear walls having respective front and rear horizontal channels therein, the rear channel having a plurality of detents positioned along the upper portion of the rear channel, an elevator plate positioned parallel to the bottom plate in the media storage area, the elevator plate having a U-shape opening having an open end adjacent the first side wall and a closed end spaced at a predetermined distance from the second side wall and a lift mechanism operatively coupled to the elevator plate for raising and lowering the media stack in the media storage area, the two-axis media restraint assembly comprising:

a user-actuated rear media restraint operatively connected via a camming member to a side media restraint, the user-actuated rear media restraint for restraining a rear edge of the stack media when present, the rear media restraint having a latching assembly for slidably engaging with one of the plurality of indents and having a first state latched to the track, and, when actuated, a second state unlatched from the track allowing the rear media restraint to slide along the track, the rear media restraint positioned parallel to the first side wall and moveable within the U-shaped opening of the elevator plate among a plurality of positions corresponding to a plurality of designed-for media lengths including a position corresponding to a shortest designed-for media length and a position corresponding to a longest designed-for media length, opposite ends of the rear media restraint slidably received into the front and rear horizontal channels;

the side media restraint slidably mounted to the front wall at a predetermined position from the first side wall and translatable into the media storage area, the side media restraint including:

a first vertical member for contacting a side edge of the media stack slidably mounted within the first vertical channel, the first vertical member having a top and a bottom end; and, a translation assembly including:

a first translation link having a first end and an opposed second end, the first end of the first translation link pivotally attached to one of the top and bottom ends of the first vertical member, the first translation link having a first cam follower portion adjacent a second end thereof; and, a biasing member operatively coupled between the first translation link and the front wall for biasing the camming portion of translation link toward the camming member;

and the camming member having a predefined camming profile surface and movable within the horizontal channel of the front wall, the camming member coupled to and moveable with the rear media restraint and slidably engaged with the cam follower portion of the first translation link, wherein, upon movement of the rear media restraint along the track on the bottom plate, the camming member moves with the rear media restraint in the same direction and the cam follower portion of the first translation link follows the camming profile surface with the first translation link translating the first vertical member of the side media restraint in a direction transverse to the front wall as the cam follower portion of the first translation link travels on the camming profile.

22. The two-axis media restraint assembly of claim 21, wherein the camming profile surface includes a plurality of heights along a length thereof in a direction transverse to a motion of the camming member, each of the plurality of heights corresponding to a plurality of media widths and each of the plurality of heights corresponding to each of the plurality of positions of the rear media restraint.

* * * * *